US012773015B2

(12) United States Patent
Lee et al.

(10) Patent No.: US 12,773,015 B2
(45) Date of Patent: Oct. 27, 2026

(54) AEROSOL-GENERATING DEVICE

(71) Applicant: KT&G CORPORATION, Daejeon (KR)

(72) Inventors: Jongsub Lee, Sungnam-si (KR); Minkyu Kim, Seoul (KR); Jueon Park, Seoul (KR); Byungsung Cho, Gwangmyung-si (KR)

(73) Assignee: KT&G CORPORATION, Daejeon (KR)

( * ) Notice: Subject to any disclaimer, the term of this patent is extended or adjusted under 35 U.S.C. 154(b) by 386 days.

(21) Appl. No.: 18/284,450

(22) PCT Filed: Apr. 28, 2022

(86) PCT No.: PCT/KR2022/006062
§ 371 (c)(1),
(2) Date: Sep. 27, 2023

(87) PCT Pub. No.: WO2022/231328
PCT Pub. Date: Nov. 3, 2022

(65) Prior Publication Data

US 2024/0156170 A1 May 16, 2024

(30) Foreign Application Priority Data

Apr. 28, 2021 (KR) ..... 10-2021-0054886

(51) Int. Cl.
*A24F 40/51* (2020.01)
*A24F 40/10* (2020.01)
(Continued)

(52) U.S. Cl.
CPC ..... *A24F 40/51* (2020.01); *A24F 40/10* (2020.01); *A24F 40/20* (2020.01); *A24F 40/30* (2020.01); *A24F 40/40* (2020.01); *A24F 40/53* (2020.01)

(58) Field of Classification Search
None
See application file for complete search history.

(56) References Cited

U.S. PATENT DOCUMENTS

2018/0049472 A1 2/2018 Mahler et al.
2020/0085100 A1 3/2020 Hoffman
(Continued)

FOREIGN PATENT DOCUMENTS

CN 207836767 9/2018
CN 110652040 1/2020
(Continued)

OTHER PUBLICATIONS

PCT International Application No. PCT/KR2022/006062, International Search Report dated Aug. 18, 2022, 2 pages.
(Continued)

*Primary Examiner* — Philip Y Louie
*Assistant Examiner* — Nicole A Szumigalski
(74) *Attorney, Agent, or Firm* — LEE, HONG, DEGERMAN, KANG & WAIMEY

(57) ABSTRACT

An aerosol-generating device is disclosed. The aerosol-generating device of the disclosure includes a housing comprising an insertion space in communication with an outside of the housing; a probe extending long and installed in the housing such that the probe is movable from the insertion space to an inside of the housing; a pressure sensor installed in the housing and located adjacent to one end of the probe; and a sealer configured to receive the probe, wherein the sealer is located between the pressure sensor and the insertion space.

11 Claims, 21 Drawing Sheets

(51) Int. Cl.

| | |
|---|---|
| ***A24F 40/20*** | (2020.01) |
| ***A24F 40/30*** | (2020.01) |
| ***A24F 40/40*** | (2020.01) |
| ***A24F 40/53*** | (2020.01) |

(56) References Cited

U.S. PATENT DOCUMENTS

| | | | | |
|---|---|---|---|---|
| 2020/0093185 | A1 | 3/2020 | Lim | |
| 2020/0170298 | A1* | 6/2020 | Lee | A24F 40/46 |
| 2020/0345066 | A1* | 11/2020 | Kim | A24F 40/42 |
| 2021/0219612 | A1* | 7/2021 | Dumen | A24F 40/485 |
| 2021/0360970 | A1* | 11/2021 | Takeuchi | A24F 40/20 |
| 2023/0044363 | A1* | 2/2023 | Li | A24F 40/53 |
| 2024/0008541 | A1* | 1/2024 | Jin | A24F 40/85 |

FOREIGN PATENT DOCUMENTS

| | | | | |
|---|---|---|---|---|
| CN | 110652040 | A * | 1/2020 | A24F 40/51 |
| CN | 111838772 | | 10/2020 | |
| CN | 212574144 | | 2/2021 | |
| EP | 4035542 | A1 * | 8/2022 | A24F 40/51 |
| JP | 2005-261938 | | 9/2005 | |
| JP | 2017-506901 | | 3/2017 | |
| JP | 2021509579 | | 4/2021 | |
| KR | 10-1001077 | | 12/2010 | |
| KR | 10-2019-0049437 | | 5/2019 | |
| KR | 10-2019-0051745 | | 5/2019 | |
| KR | 10-2019-0129757 | | 11/2019 | |
| KR | 10-2019-0143725 | | 12/2019 | |
| KR | 10-2021-0042747 | | 4/2021 | |
| WO | 2018190603 | | 10/2018 | |
| WO | 2019208974 | | 10/2019 | |
| WO | 2020148334 | | 7/2020 | |
| WO | 2020161489 | | 8/2020 | |
| WO | 2020174624 | | 9/2020 | |

OTHER PUBLICATIONS

Korean Intellectual Property Office Application No. 10-2021-0054886, Notice of Allowance dated Apr. 24, 2023, 2 pages.

Japan Patent Office Application No. 2023-564491, Office Action dated Oct. 29, 2024, 4 pages.

European Patent Office Application Serial No. 22796160.4, Search Report dated Feb. 10, 2025, 11 pages.

The State Intellectual Property Office of the People's Republic of China Application Serial No. 202280028170.3, Office Action dated Mar. 10, 2026, 7 pages.

* cited by examiner

[Fig. 1]
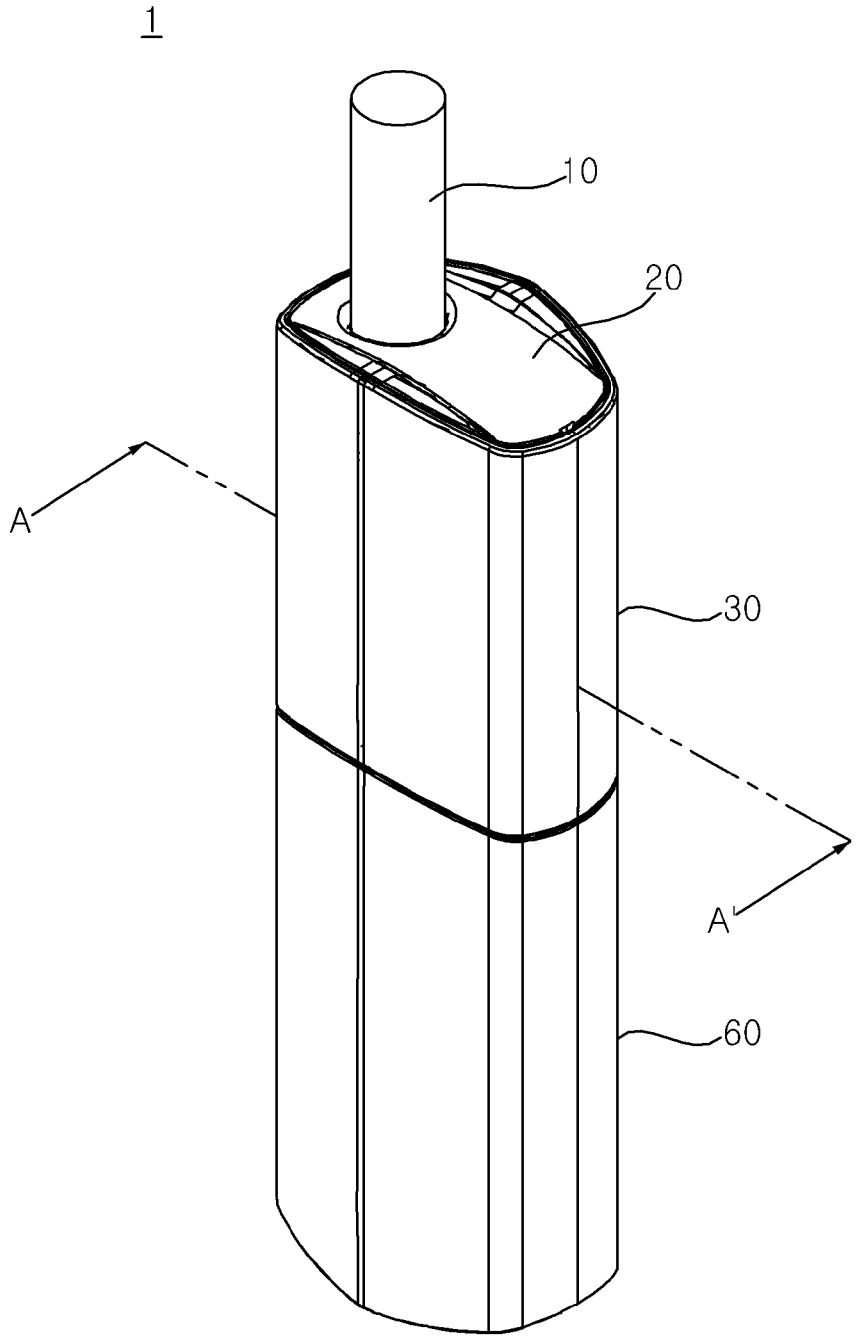

[Fig. 2]
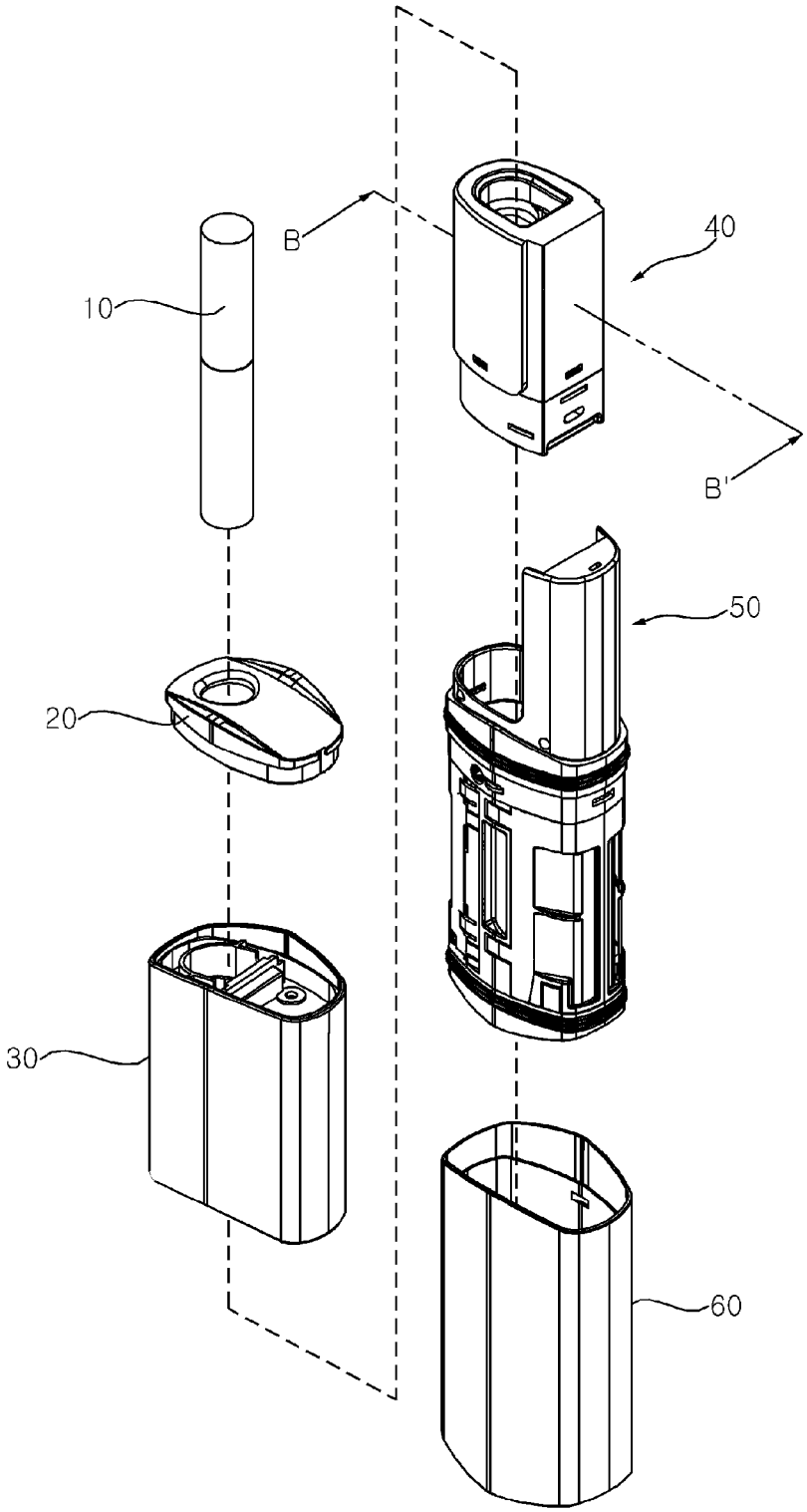

[Fig. 3]
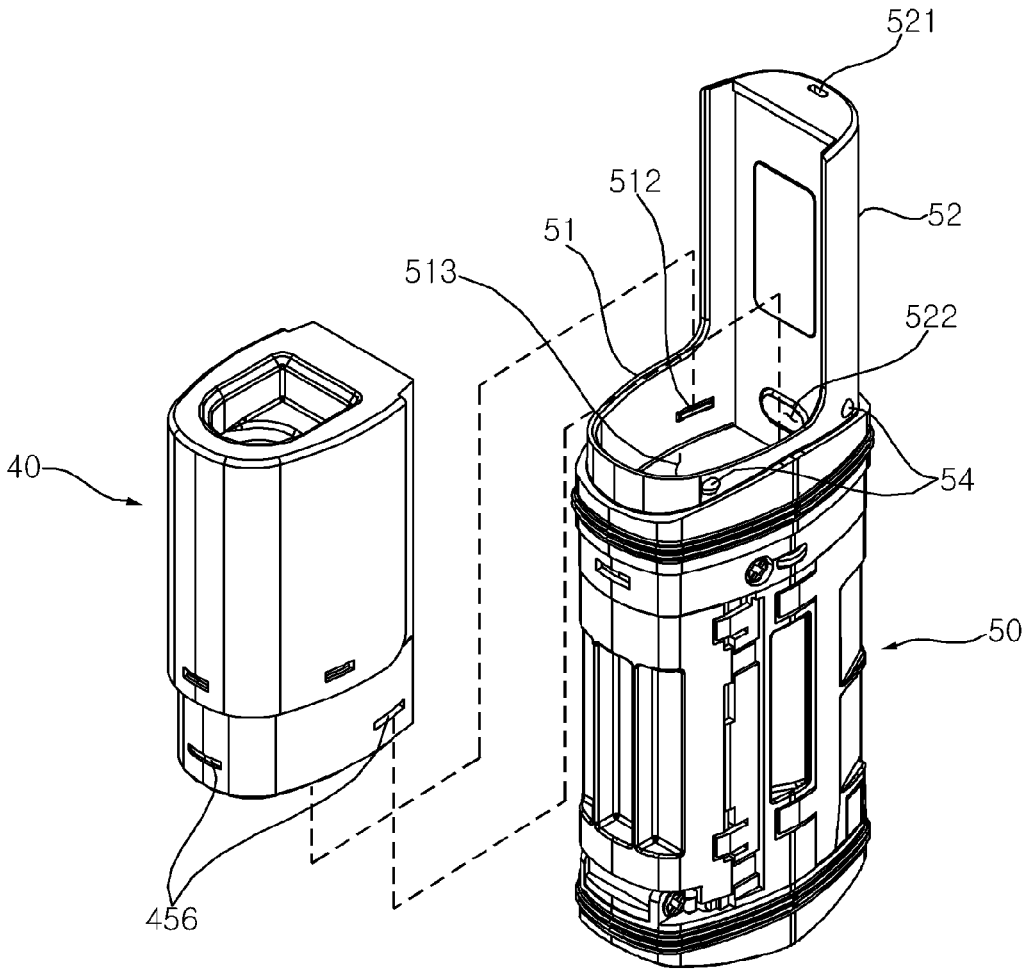

[Fig. 4]
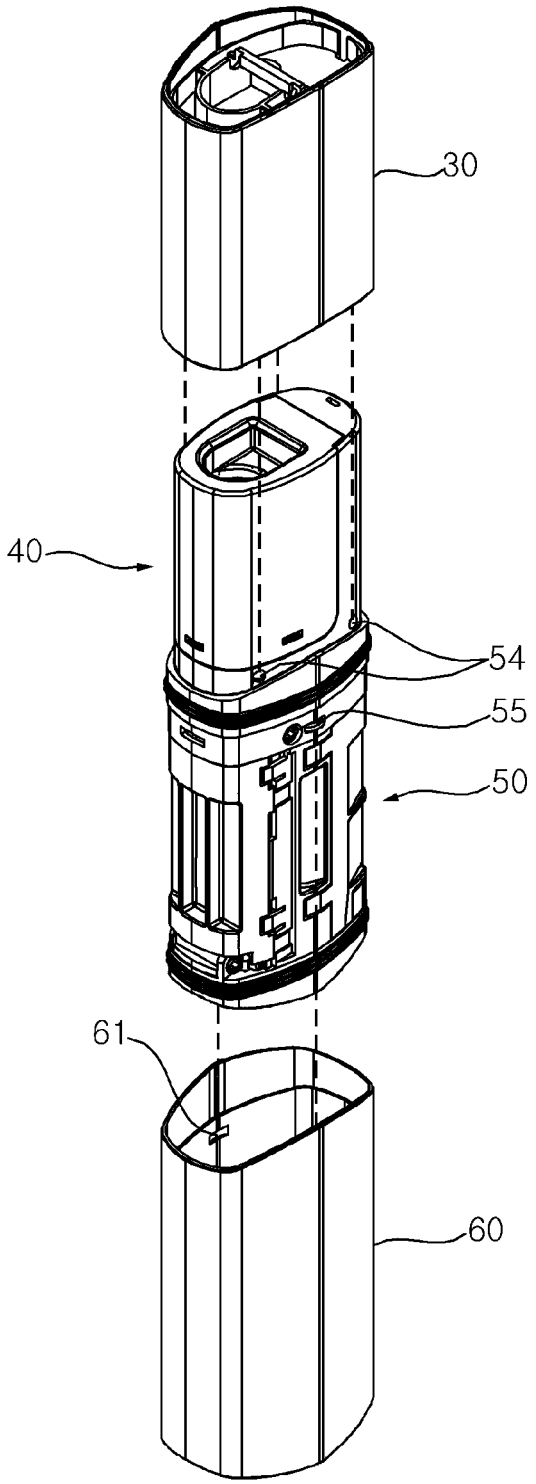

[Fig. 5]
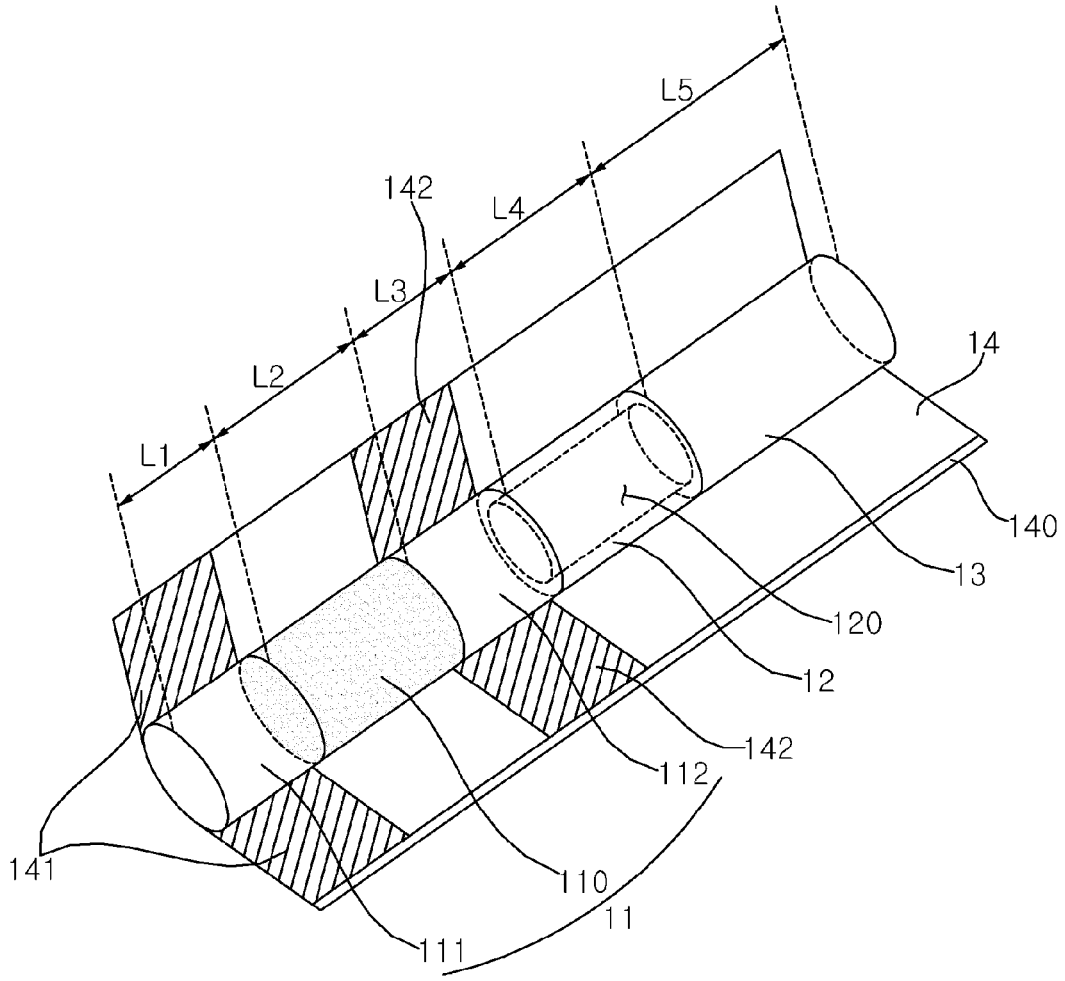

[Fig. 6]
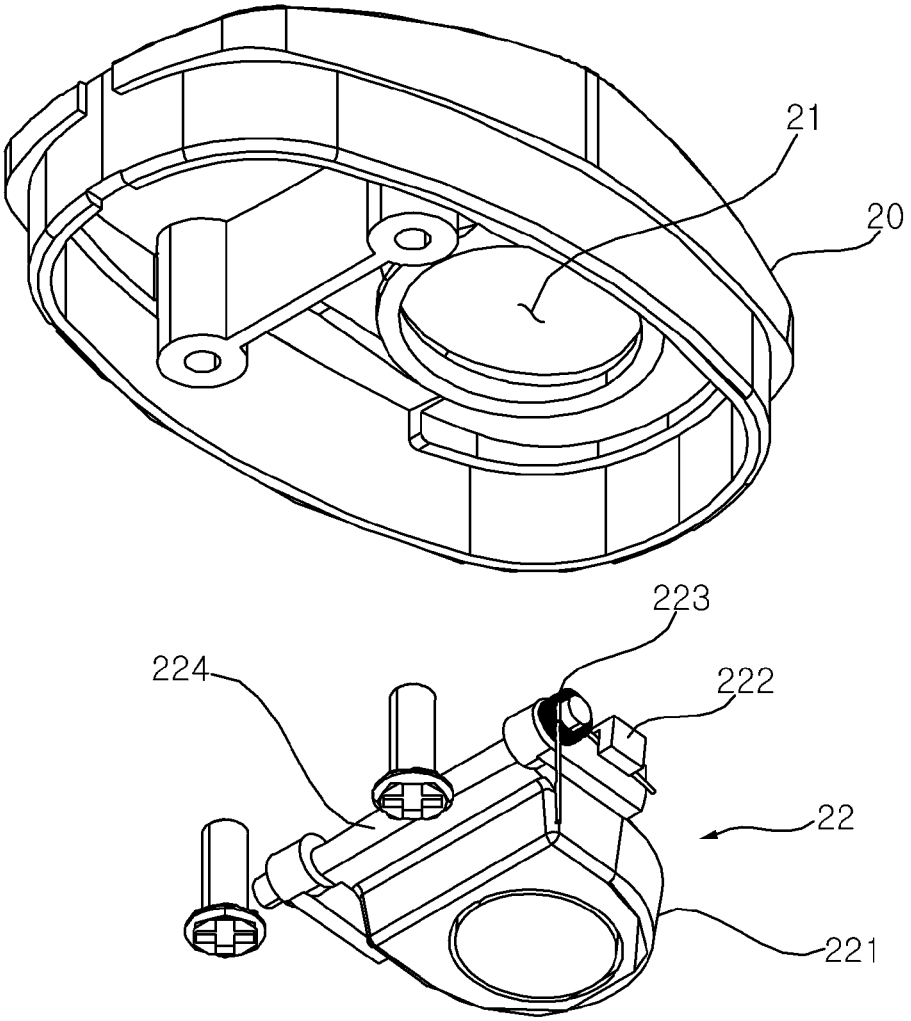

[Fig. 7]
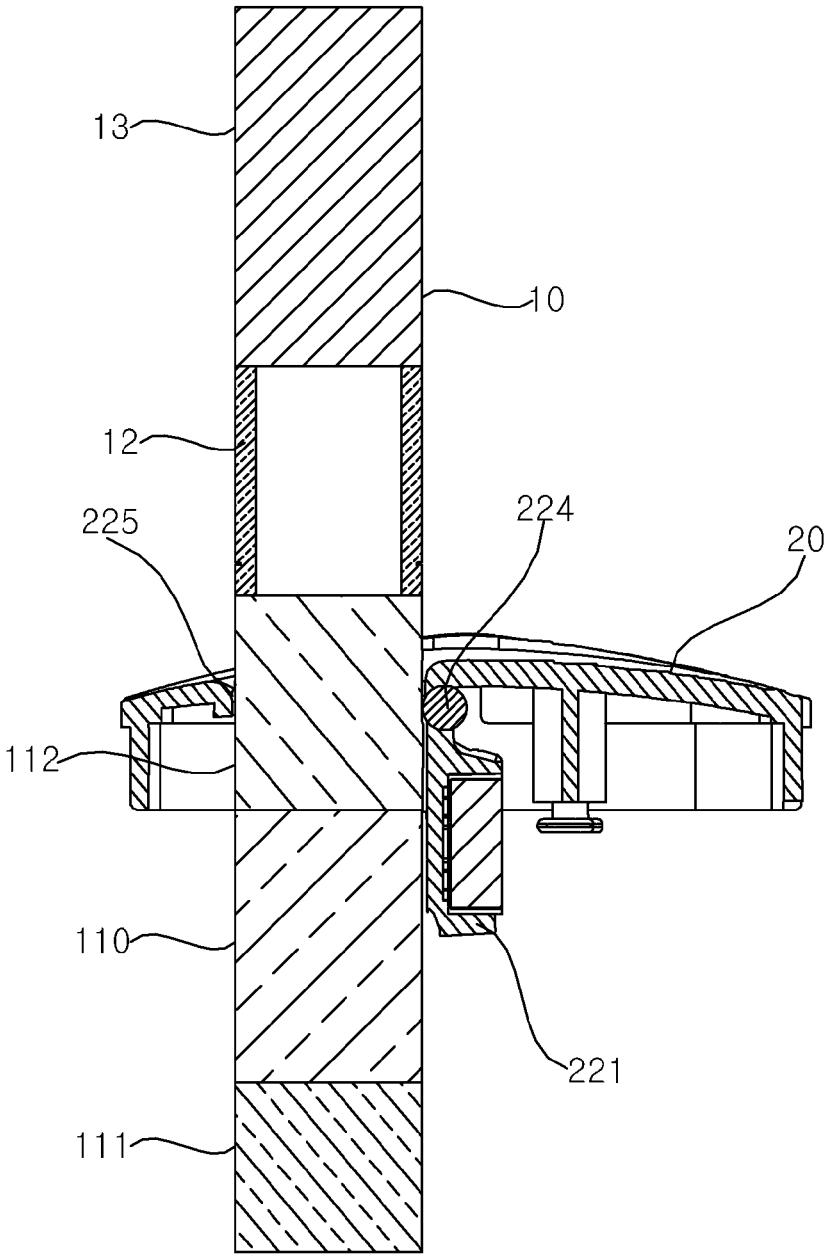

[Fig. 8]
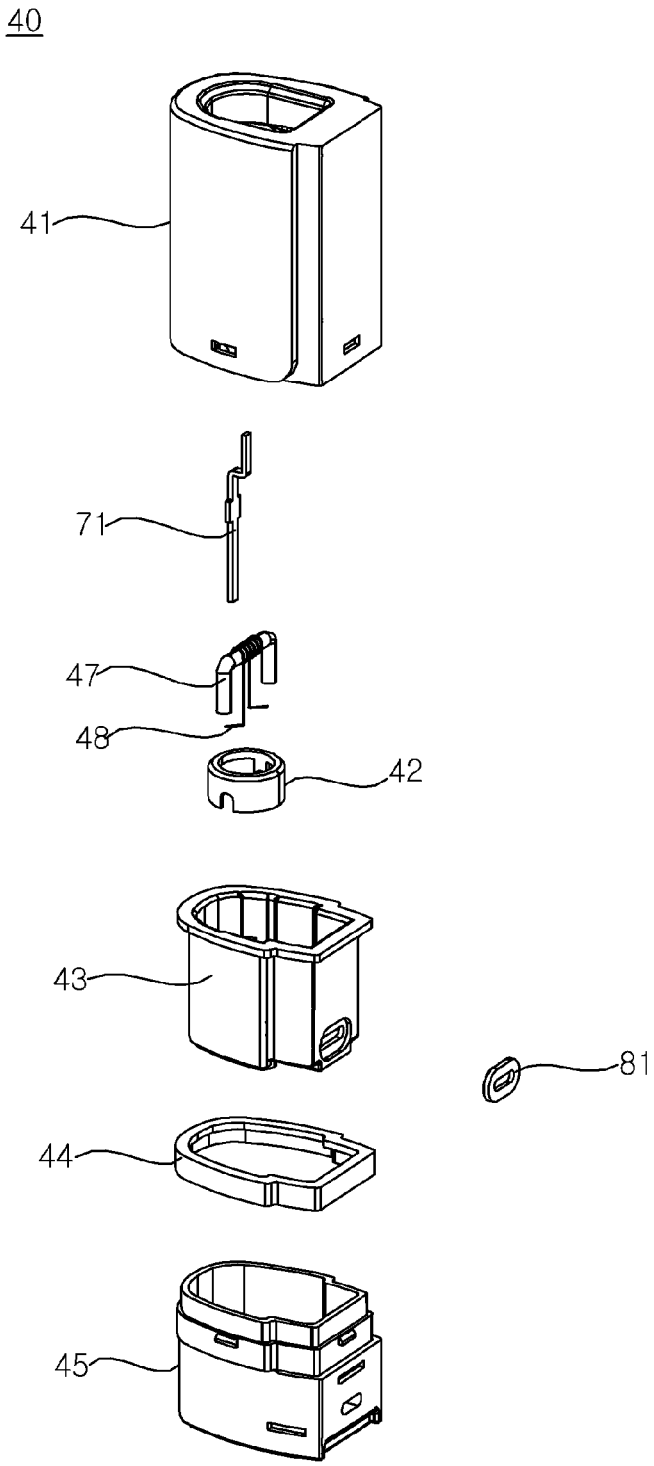

[Fig. 9]
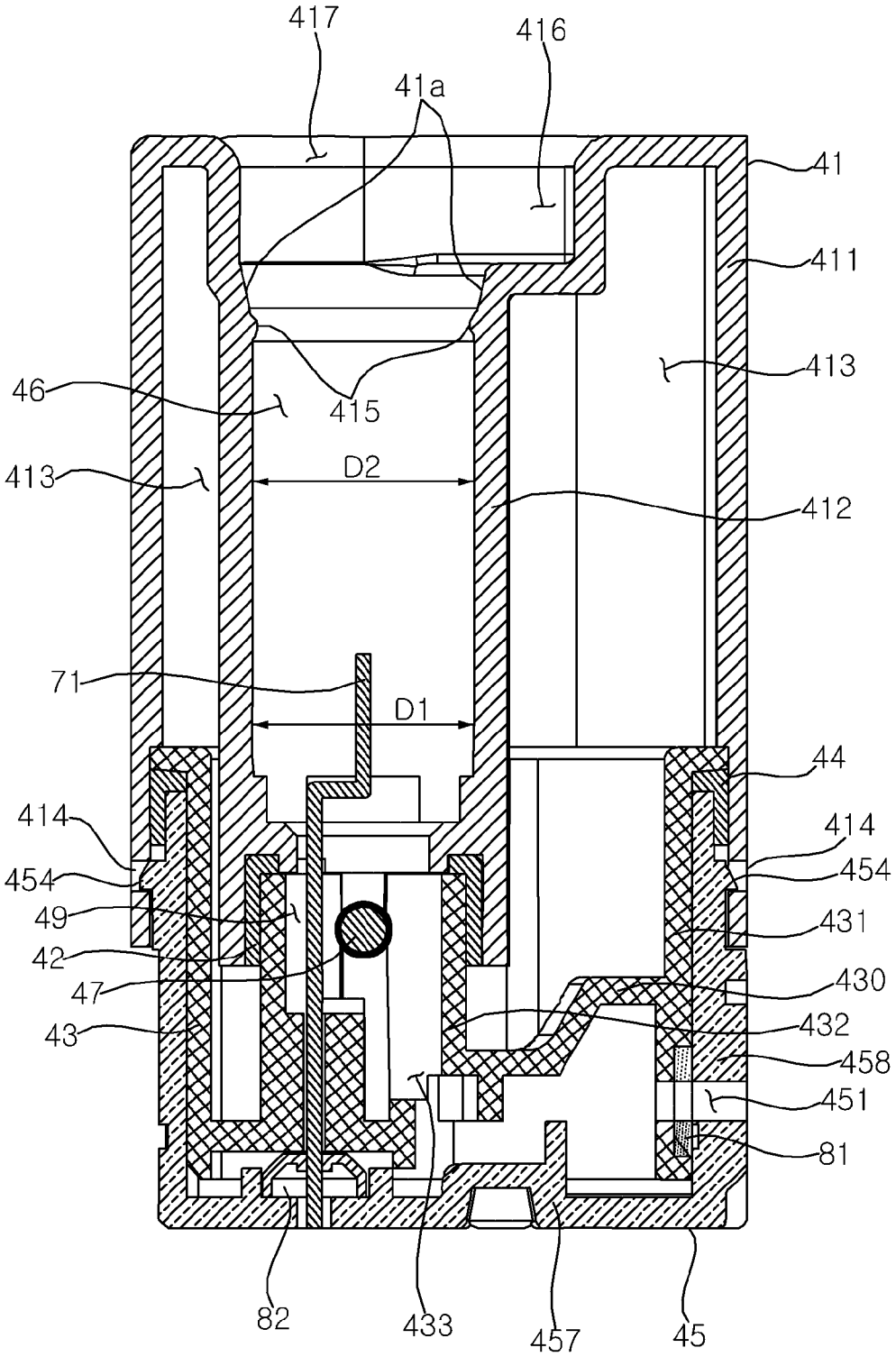

[Fig. 10]
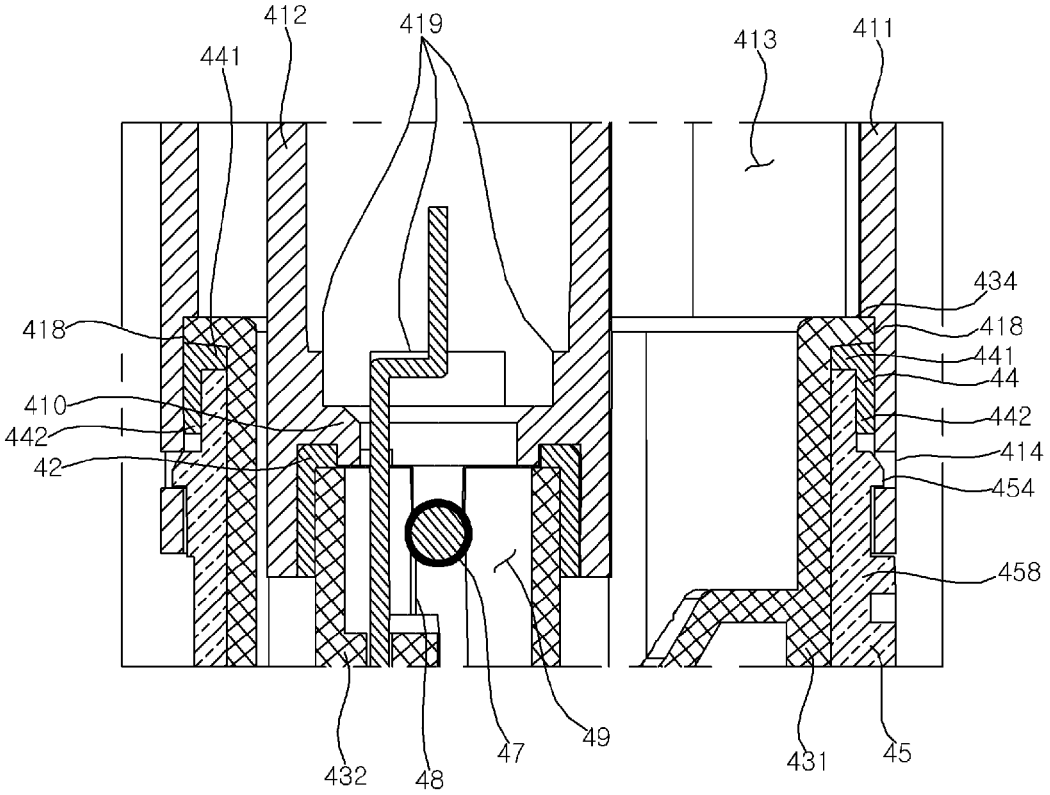

[Fig. 11]
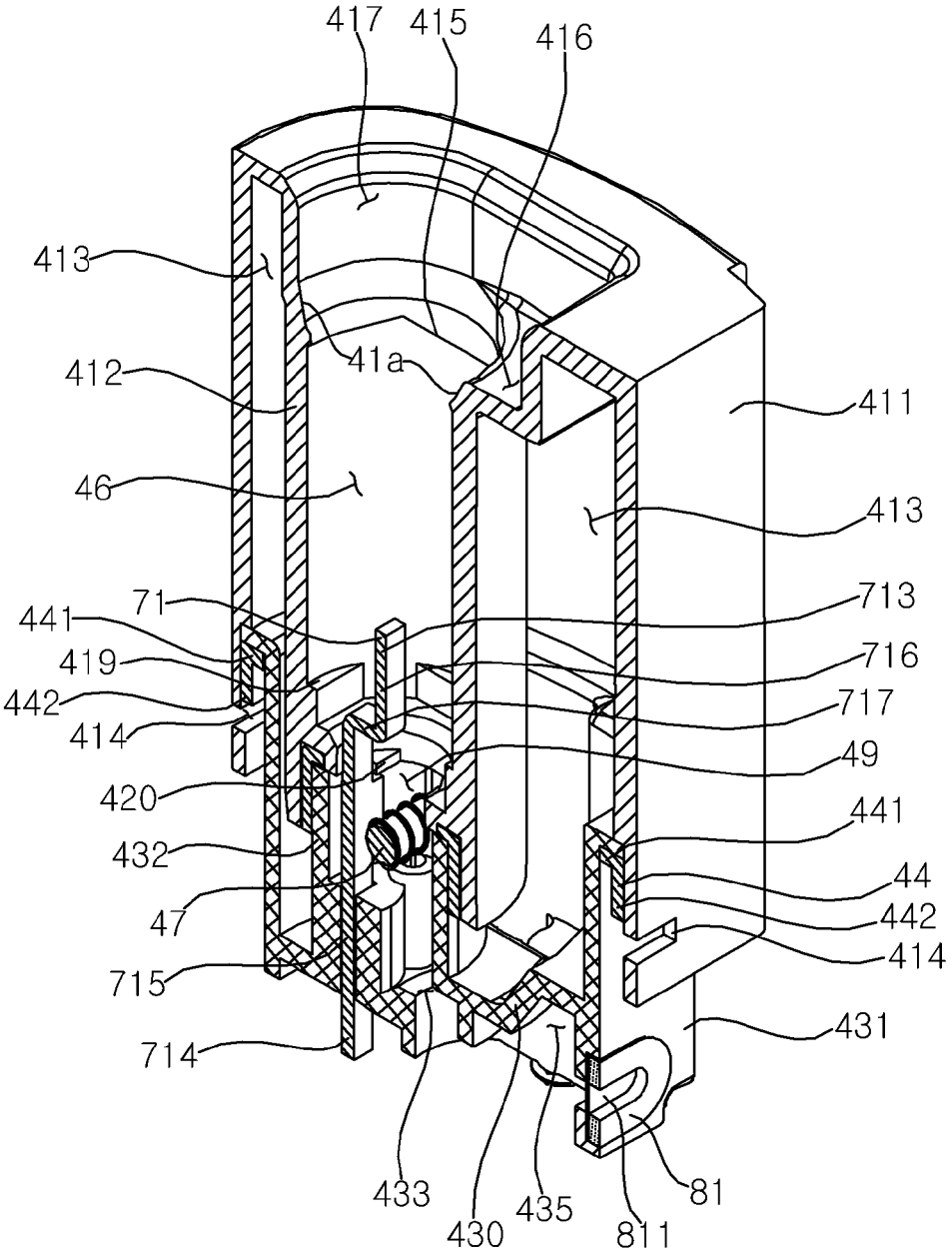

[Fig. 12]
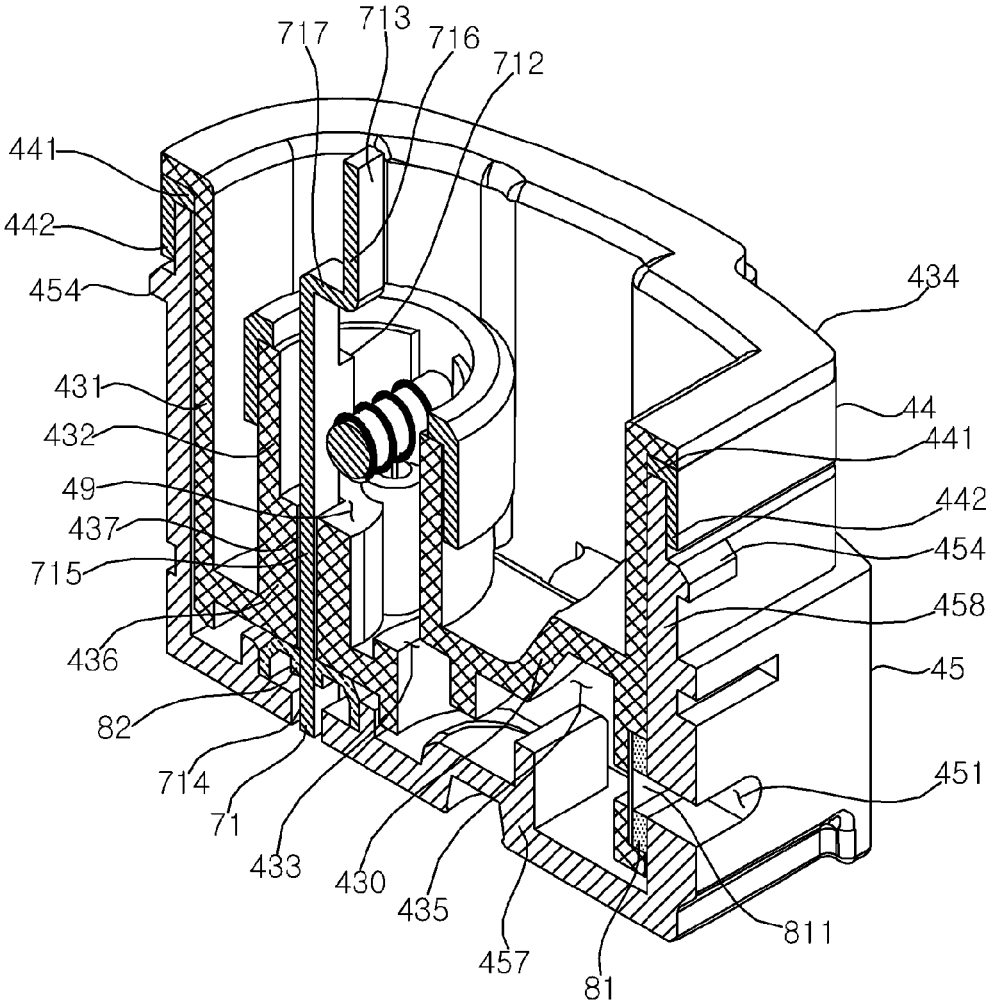

[Fig. 13]
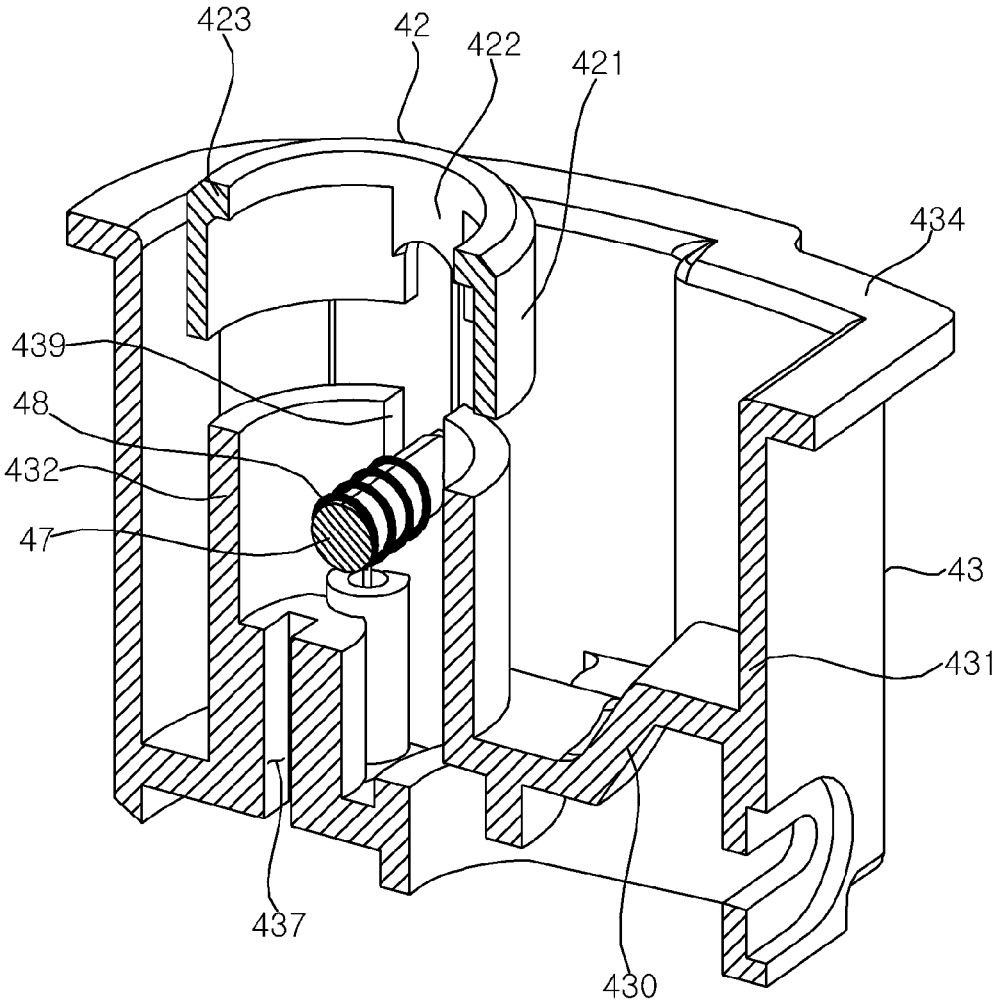

【FIG. 14】
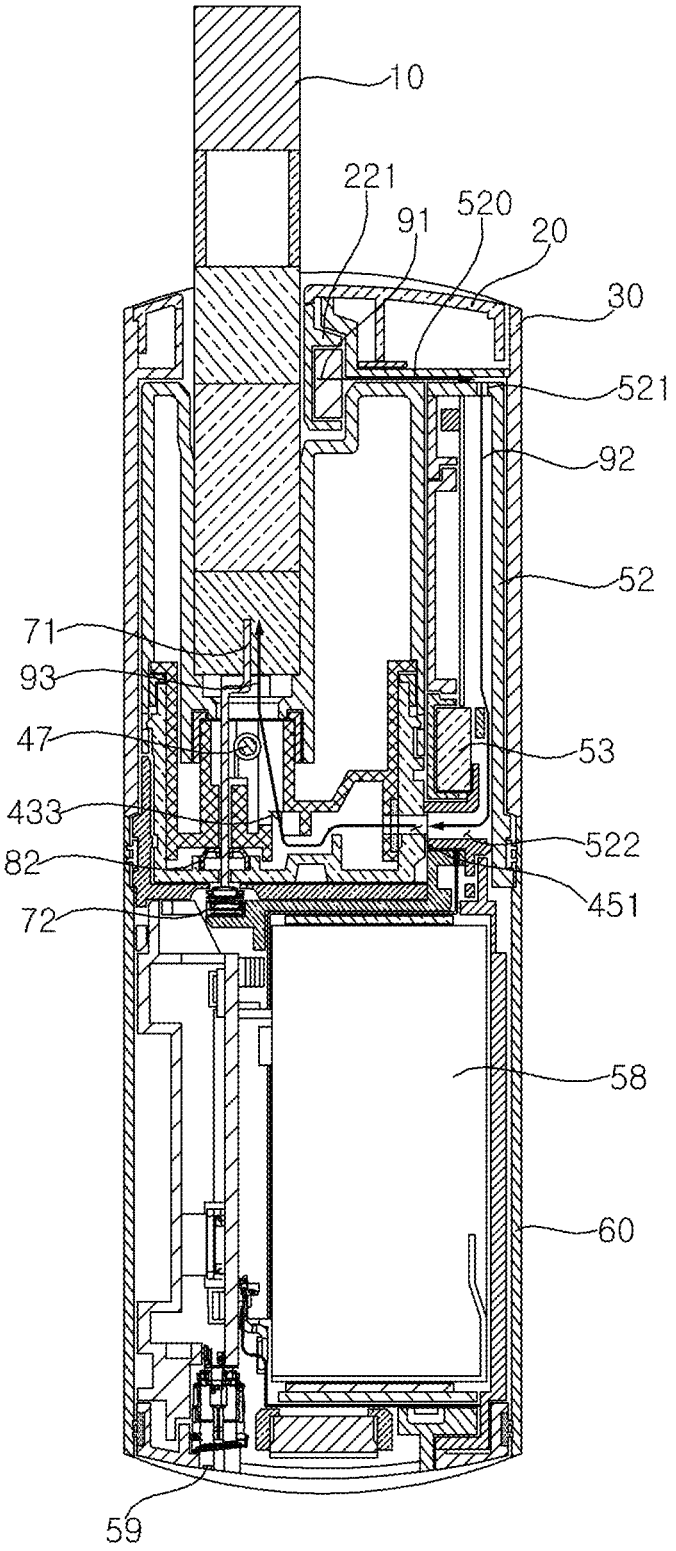

[Fig. 15]
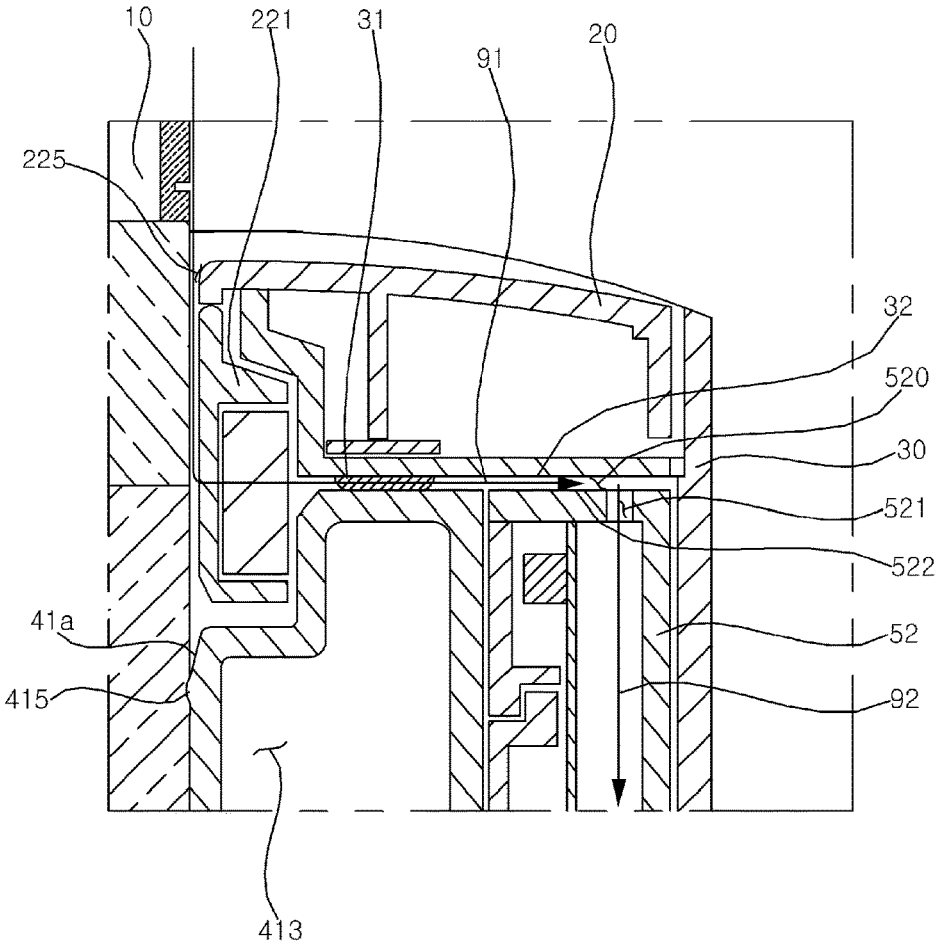
[Fig. 16]
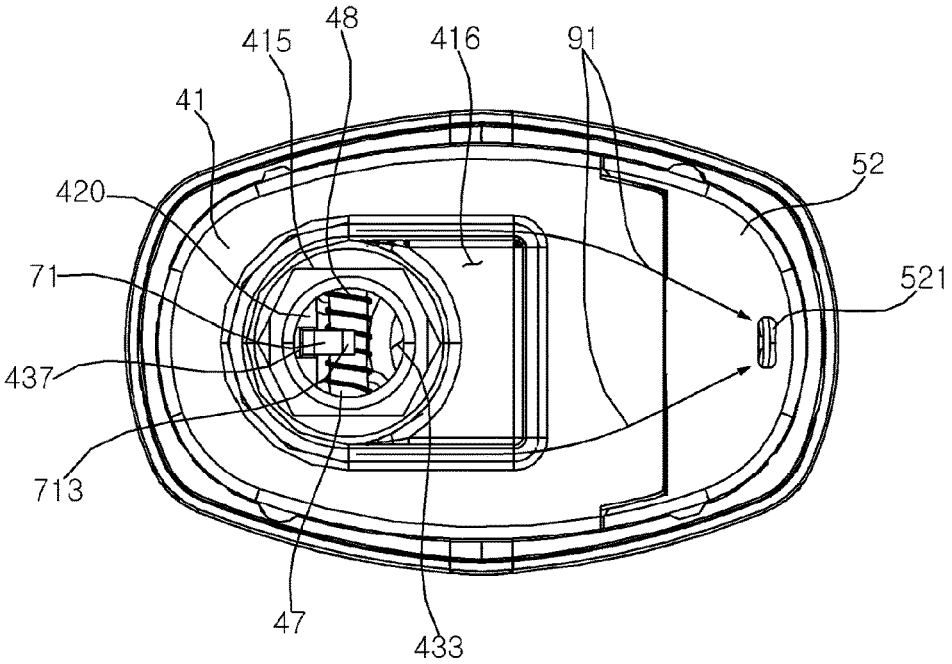

【FIG. 17】
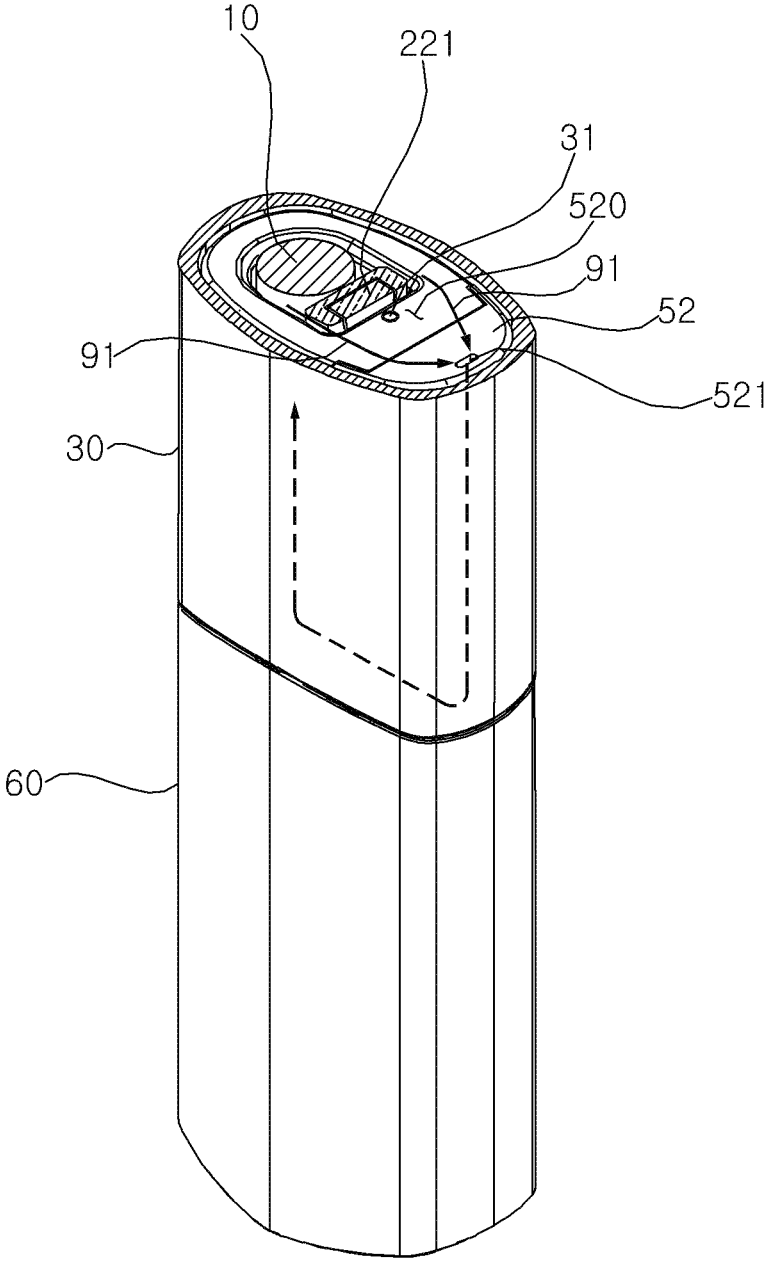

[Fig. 18]
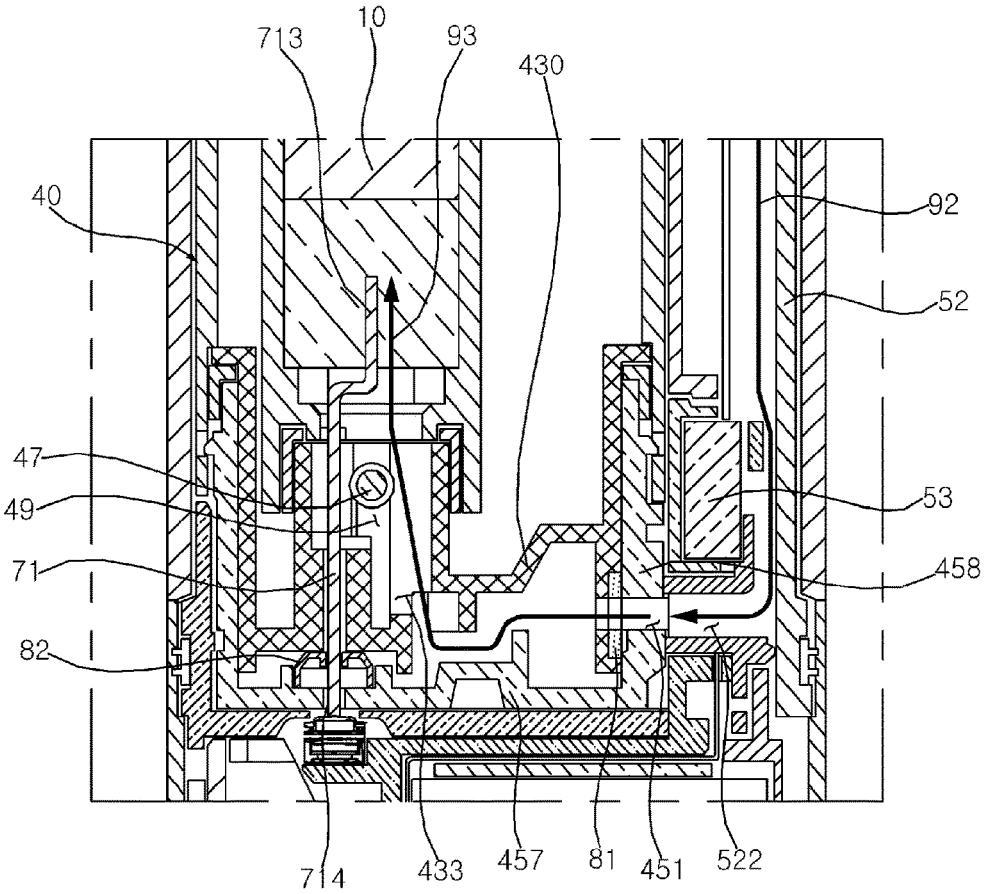
[Fig. 19]
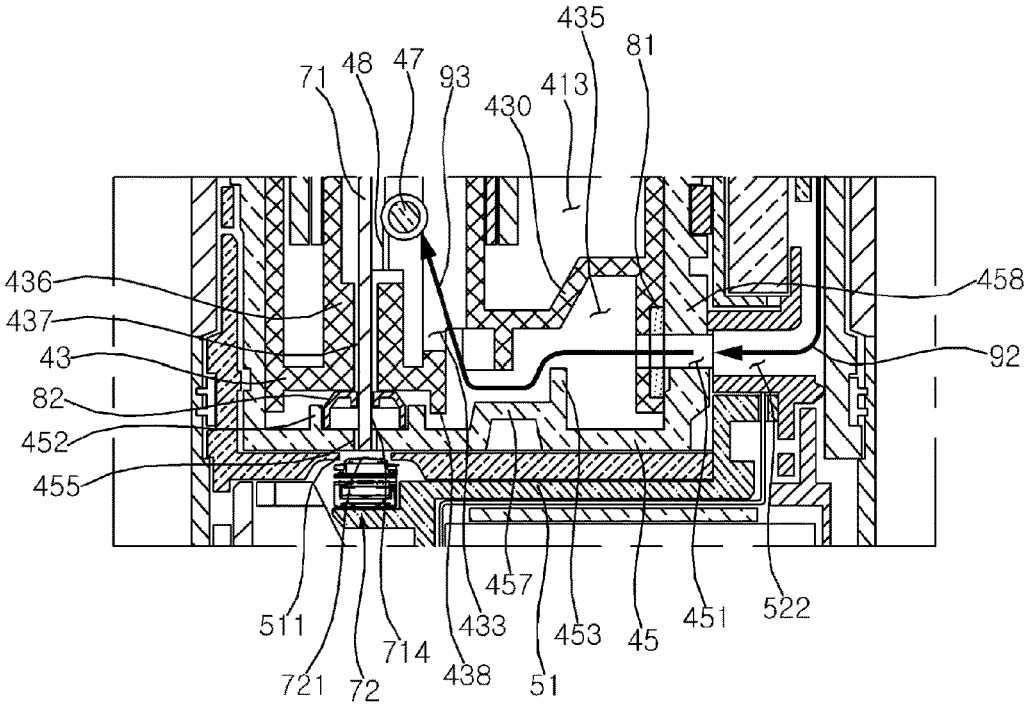

[Fig. 20]
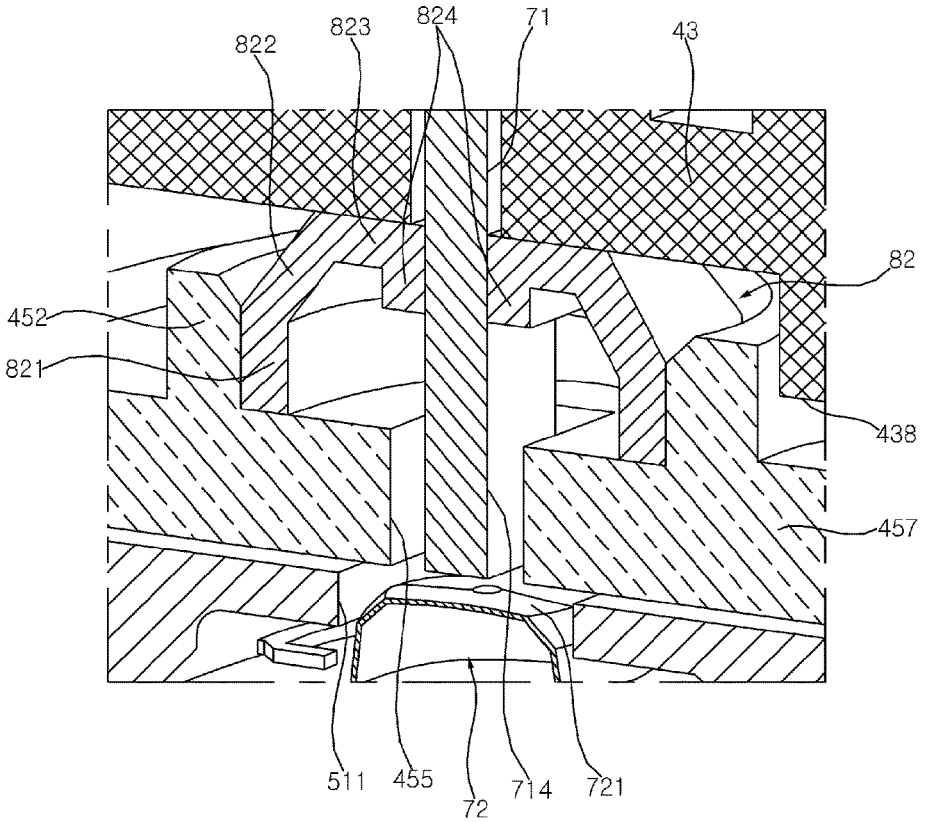
[Fig. 21]
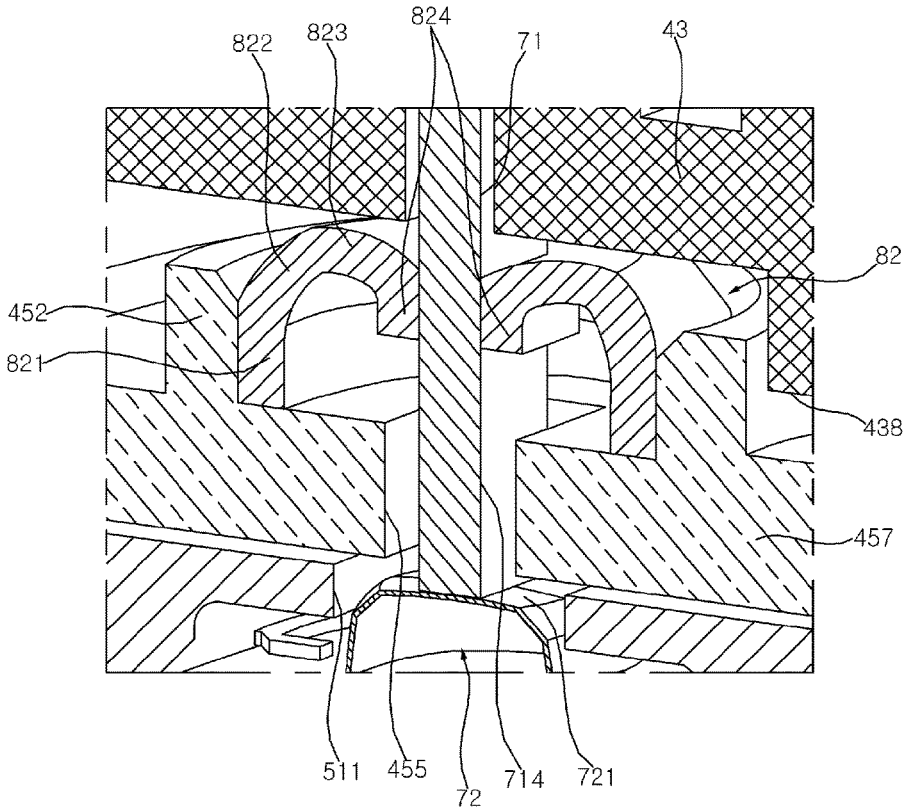

[Fig. 22]
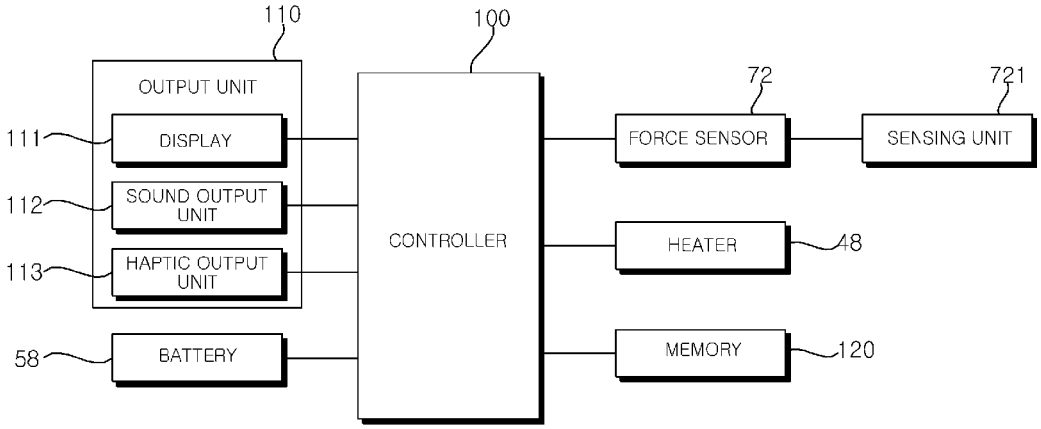

[Fig. 23]
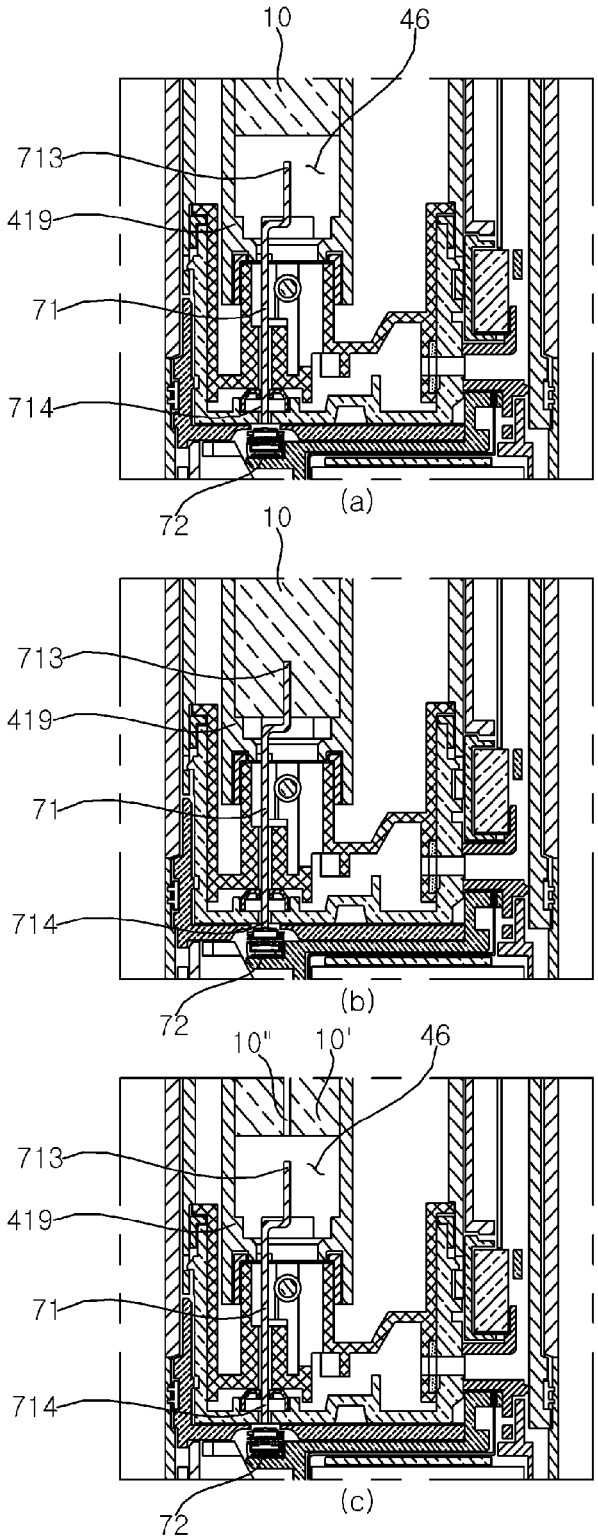

[Fig. 24]
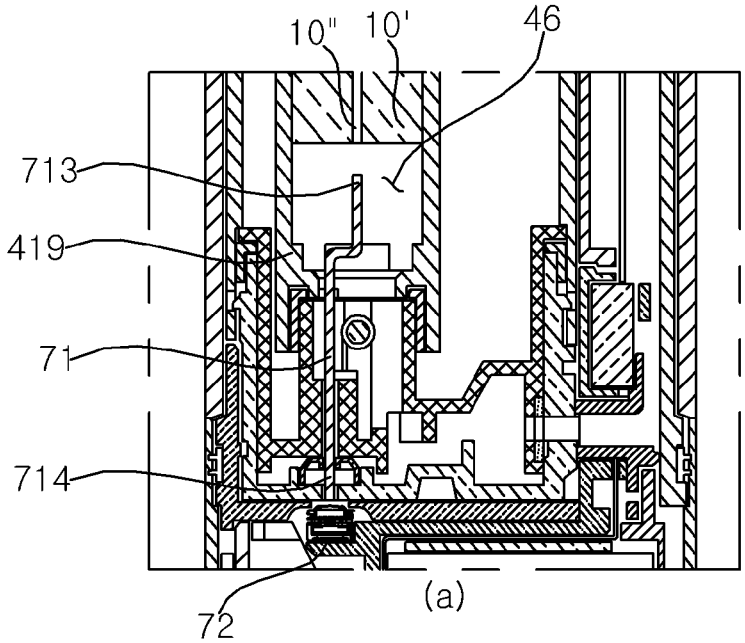
(a)
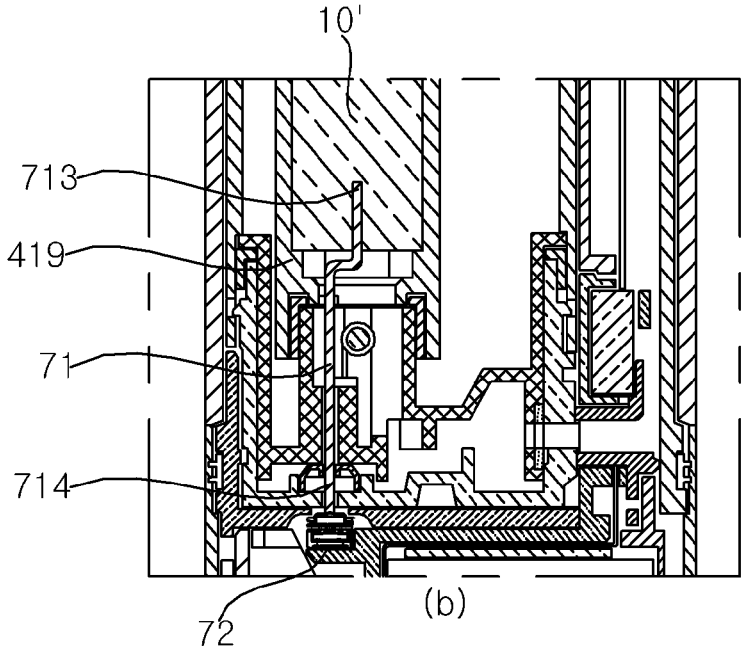
(b)

AEROSOL-GENERATING DEVICE

CROSS-REFERENCE TO RELATED APPLICATIONS

This application is the National Stage filing under 35 U.S.C. 371 of International Application No. PCT/KR2022/006062, filed on Apr. 28, 2022, which claims the benefit of earlier filing date and right of priority to Korean Application No. 10-2021-0054886, filed on Apr. 28, 2021, the contents of which are all hereby incorporated by reference herein their entirety.

TECHNICAL FIELD

The present disclosure relates to an aerosol-generating device.

BACKGROUND ART

An aerosol-generating device is a device that extracts certain components from a medium or a substance by forming an aerosol. The medium may contain a variety of substances. The substance contained in the medium may be a multicomponent flavoring substance. For example, the substance contained in the medium may include a nicotine component, an herbal component, and/or a coffee component. Recently, various research on aerosol-generating devices has been conducted.

DISCLOSURE OF INVENTION

Technical Problem

It is an objective of the present disclosure to solve the above and other problems.

It is another objective of the present disclosure to provide an aerosol-generating device configured to sense reuse of a stick.

It is another objective of the present disclosure to provide an aerosol-generating device capable of preventing leakage of liquid.

Solution to Problem

In accordance with an aspect of the present disclosure for accomplishing the above objectives, there is provided an aerosol-generating device including a housing comprising an insertion space in communication with an outside of the housing; a probe extending long and installed in the housing such that the probe is movable from the insertion space to an inside of the housing; a pressure sensor installed in the housing and located adjacent to one end of the probe; and a sealer configured to receive the probe, wherein the sealer is located between the pressure sensor and the insertion space.

Advantageous Effects of Invention

According to at least one of embodiments of the present disclosure, it is possible to sense whether a stick is a used one.

According to at least one of embodiments of the present disclosure, a cartridge structure capable of preventing leakage of liquid may be provided.

Additional applications of the present disclosure will become apparent from the following detailed description. However, because various changes and modifications will be clearly understood by those skilled in the art within the spirit and scope of the present disclosure, it should be understood that the detailed description and specific embodiments, such as preferred embodiments of the present disclosure, are merely given by way of example.

BRIEF DESCRIPTION OF DRAWINGS

FIGS. 1 to 24 show examples of an aerosol-generating device according to embodiments of the present disclosure.

BEST MODE FOR CARRYING OUT THE INVENTION

Hereinafter, the embodiments disclosed in the present specification will be described in detail with reference to the accompanying drawings, and the same or similar elements are denoted by the same reference numerals even though they are depicted in different drawings, and redundant descriptions thereof will be omitted.

In the following description, with respect to constituent elements used in the following description, the suffixes "module" and "unit" are used only in consideration of facilitation of description, and do not have mutually distinguished meanings or functions.

In addition, in the following description of the embodiments disclosed in the present specification, a detailed description of known functions and configurations incorporated herein will be omitted when the same may make the subject matter of the embodiments disclosed in the present specification rather unclear. In addition, the accompanying drawings are provided only for a better understanding of the embodiments disclosed in the present specification and are not intended to limit the technical ideas disclosed in the present specification. Therefore, it should be understood that the accompanying drawings include all modifications, equivalents, and substitutions within the scope and sprit of the present disclosure.

It will be understood that although the terms "first", "second", etc., may be used herein to describe various components, these components should not be limited by these terms. These terms are only used to distinguish one component from another component.

It will be understood that when a component is referred to as being "connected to" or "coupled to" another component, it may be directly connected to or coupled to another component, or intervening components may be present. On the other hand, when a component is referred to as being "directly connected to" or "directly coupled to" another component, there are no intervening components present.

As used herein, the singular form is intended to include the plural forms as well, unless the context clearly indicates otherwise.

Referring to FIG. 1, an aerosol-generating device 1 may include a cover 20, an upper casing 30, and a lower casing 60, and a stick 10 may be inserted into the cover 20.

The cover 20, the upper casing 30, and the lower casing 60 may together form the external appearance of the aerosol-generating device 1. The lower casing 60 may be coupled to the lower side of the upper casing 30. The cover 20 may cover the upper surface of the upper casing 30. An insertion hole 21 (refer to FIG. 5) may be formed in the cover 20, and a stick 10 for inhalation of an aerosol may be inserted into the insertion hole 21. A user may grasp the upper casing 30 or the lower casing 60 to inhale the aerosol formed in the aerosol-generating device 1 through the stick 10 inserted thereinto. Other components may be accommodated in the upper casing 30 and the lower casing 60.

Referring to FIGS. 2 to 4, the aerosol-generating device 1 may include a cover 20, an upper casing 30, a cartridge 40, a body 50, and a lower casing 60. A stick 10 may be inserted into the cover 20.

The upper casing 30 may be mounted outside the body 50. The lower casing 60 may be mounted outside the body 50. The cartridge 40 may be mounted inside the body 50. The cover 20 may be mounted on the upper casing 30. The stick 10 may be inserted into the cartridge 40 through the cover 20 and the upper casing 30.

The cartridge 40 may be mounted inside the body 50. The body 50 may include a mount 51 on which the cartridge 40 is mounted. The body 50 may include a column 52 through which air flows. Electronic components necessary for formation of an aerosol may be mounted inside the body 50. In addition, the body 50 may accommodate therein a controller 100 (refer to FIG. 22) for controlling the generation of an aerosol and the operation of the aerosol-generating device 1.

Space for accommodating the cartridge 40 may be formed in the mount 51. A protrusion 512 may be formed on the inner side of the mount 51, and a groove456, which is caught by the protrusion 512 of the mount 51, may be formed in the outer side of the cartridge 40. The protrusion 512 of the mount 51 may be fitted into the groove456 in the cartridge 40. The mount 51 may be integrally formed with the column 52. The mount 51 may be located at the upper side of the body 50. An inner space 513 in the mount 51, in which the cartridge 40 is accommodated, may communicate with the outside.

The column 52 may have formed therein a first opening 521 and a second opening 522, through which the inside of the column 52 communicates with the outside. The column 52 may be located adjacent to an upper housing 41 (refer to FIG. 8) and a lower housing 43 (refer to FIG. 8). The column 52 may be elongated upwards from the body 50. The column 52 may extend in the longitudinal direction of the upper housing 41. The column 52 may include a flow path therein. The air introduced into the column 52 through the first opening 521 may be discharged to the outside of the column 52 through the second opening 522.

The body 50 may have a plurality of protrusions 54 and 55 formed on the outer surface thereof so as to be coupled to the upper casing 30 and the lower casing 60. The protrusion 54 of the body 50 may be fitted into a groove (not shown) formed in the upper casing 30. The protrusion 55 formed on the outer surface of the body 50 may be fitted into a groove61 formed in the lower casing 60. The upper casing 30 and the lower casing 60 may protect the cartridge 40 and the body 50. The upper casing 30 may be coupled to the upper side of the body 50 to surround the upper portion of the body 50. The lower casing 60 may be coupled to the lower side of the body 50 to surround the lower portion of the body 50.

Referring to FIG. 5, the aforementioned stick 10 may include a medium portion 11. The stick 10 may include a cooling portion 12. The stick 10 may include a filter portion 13. The cooling portion 12 may be disposed between the medium portion 11 and the filter portion 13. The stick 10 may include a wrapper 14. The wrapper 14 may wrap the medium portion 11. The wrapper 14 may wrap the cooling portion 12. The wrapper 14 may wrap the filter portion 13. The stick 10 may have a cylindrical shape.

The medium portion 11 may include a medium 114. The medium portion 11 may include a first medium cover 115. The medium portion 11 may include a second medium cover 116. The medium 114 may be disposed between the first medium cover 115 and the second medium cover 116. The first medium cover 115 may be disposed at one end of the stick 10. The medium portion 11 may have a length of 24 mm.

The medium 114 may contain a multicomponent substance. The substance contained in the medium may be a multicomponent flavoring substance. The medium 114 may be composed of a plurality of granules. Each of the plurality of granules may have a size of 0.4 mm to 1.12 mm. The granules may account for approximately 70% of the volume of the medium 114. The length L2 of the medium 114 may be 10 mm. The first medium cover 115 may be made of an acetate material. The second medium cover 116 may be made of an acetate material. The first medium cover 115 may be made of a paper material. The second medium cover 116 may be made of a paper material. At least one of the first medium cover 115 or the second medium cover 116 may be made of a paper material, and may be crumpled so as to be wrinkled, and a plurality of gaps may be formed between the wrinkles so that air flows therethrough. Each of the gaps may be smaller than each of the granules of the medium 114. The length L1 of the first medium cover 115 may be shorter than the length L2 of the medium 114. The length L3 of the second medium cover 115 may be shorter than the length L2 of the medium 114. The length L1 of the first medium cover 115 may be 7 mm. The length L2 of the second medium cover 115 may be 7 mm.

Accordingly, each of the granules of the medium 114 may be prevented from being separated from the medium portion 11 and the stick 10.

The cooling portion 12 may have a cylindrical shape. The cooling portion 12 may have a hollow shape. The cooling portion 12 may be disposed between the medium portion 11 and the filter portion 13. The cooling portion 12 may be disposed between the second medium cover 116 and the filter portion 13. The cooling portion 12 may be formed in the shape of a tube that surrounds a cooling path 121 formed therein. The cooling portion 12 may be thicker than the wrapper 14. The cooling portion 12 may be made of a paper material thicker than that of the wrapper 14. The length L4 of the cooling portion 12 may be equal or similar to the length L2 of the medium 114. The length L4 of each of the cooling portion 12 and the cooling path 121 may be 10 mm. When the stick 10 is inserted into the aerosol-generating device (refer to FIG. 3), at least part of the cooling portion 12 may be exposed to the outside of the aerosol-generating device.

Accordingly, the cooling portion 12 may support the medium portion 11 and the filter portion 13, and may secure the rigidity of the stick 10. In addition, the cooling portion 12 may support the wrapper 14 between the medium portion 11 and the filter portion 13, and may provide a portion to which the wrapper 14 is adhered. In addition, the heated air and aerosol may be cooled while passing through the cooling path 121 in the cooling portion 12.

The filter portion 13 may be composed of a filter made of an acetate material. The filter portion 13 may be disposed at the other end of the stick 10. When the stick 10 is inserted into the aerosol-generating device (refer to FIG. 3), the filter portion 13 may be exposed to the outside of the aerosol-generating device. The user may inhale air in the state of holding the filter portion 13 in the mouth. The length L5 of the filter portion 13 may be 14 mm.

The wrapper 14 may wrap or surround the medium portion 11, the cooling portion 12, and the filter portion 13. The wrapper 14 may form the external appearance of the stick 10. The wrapper 14 may be made of a paper material. An adhesive portion 140 may be formed along one edge of the wrapper 14. The wrapper 14 may surround the medium portion 11, the cooling portion 12, and the filter portion 13, and the adhesive portion 140 formed along one edge of the wrapper 14 and the other edge thereof may be adhered to each other. The wrapper 14 may surround the medium portion 11, the cooling portion 12, and the filter portion 13, but may not cover one end or the other end of the stick 10.

Accordingly, the wrapper 14 may fix the medium portion 11, the cooling portion 12, and the filter portion 13, and may prevent these components from being separated from the stick 10.

A first thin film 141 may be disposed at a position corresponding to the first medium cover 115. The first thin film 141 may be disposed between the wrapper 14 and the first medium cover 115, or may be disposed outside the wrapper 14. The first thin film 141 may surround the first medium cover 115. The first thin film 141 may be made of a metal material. The first thin film 141 may be made of an aluminum material. The first thin film 141 may be in close contact with the wrapper 14, or may be coated thereon.

A second thin film 142 may be disposed at a position corresponding to the second medium cover 116. The second thin film 142 may be disposed between the wrapper 14 and the second medium cover 116, or may be disposed outside the wrapper 14. The second thin film 142 may be made of a metal material. The second thin film 142 may be made of an aluminum material. The second thin film 142 may be in close contact with the wrapper 14, or may be coated thereon.

Referring to FIGS. 6 and 7, the cover 20 may include an insertion hole 21, into which the stick 10 is inserted, and a cap 22 for opening and closing the insertion hole 21.

The insertion hole 21 may be formed in the cover 20. The insertion hole 21 may have a shape corresponding to the circumference of the stick 10. The stick 10 may pass through the insertion hole 21. A first gap 225 may be formed between the stick 10, inserted into the insertion hole 21, and the insertion hole 21. Air may pass through the first gap 225.

The cap 22 may be located below the insertion hole 21. The cap 22 may be coupled to the cover 20 using a rotating shaft 224. The cap 22 may include a lid 221, which covers the insertion hole 21 and is coupled to the rotating shaft 224, an elastic member 223, which applies elastic force to the lid 221, and a latch 222, which is formed at the lid 221 and latches the elastic member 223. The elastic member 223 may be in contact with the latch 222. The elastic member 223 latched by the latch 222 may apply elastic force to the lid 221. The lid 221 may be kept in close contact with the insertion hole 21 by the elastic force.

Meanwhile, when the stick 10 is inserted into the insertion hole 21, the lid 221 may be rotated by the stick 10, and the elastic member 223 may be compressed. When the stick 10 is removed from the aerosol-generating device 1, the compressed elastic member 223 applies restoring force to the latch 222, and the lid 221 coupled to the latch 222 may be rotated and brought into close contact with the insertion hole 21 by the restoring force.

Referring to FIGS. 8 and 9, the cartridge 40 may include an upper housing 41, a lower housing 43, a base 45, a first gasket 42, a second gasket 44, an insertion space 46, a wick 47, a heater 48, and a liquid vaporization space 49. A probe 71 (refer to FIG. 9) may be mounted inside the cartridge 40. A first sealer 81 may be disposed in the cartridge 40.

The upper housing 41 may include a first outer wall 411, a first inner wall 412, a container 413, a coupling groove414, a support rib 415, a cap-receiving portion 416, an opening 417, and a slope 41*a*.

The first outer wall 411 may be elongated. The first outer wall 411 may be elongated vertically. The first outer wall 411 may form the outer surface of the upper portion of the cartridge 40. The first outer wall 411 may be integrally formed with the first inner wall 412. The first outer wall 411 may have a flat outer surface. The first outer wall 411 may have a shape corresponding to that of the first inner wall 412. The first outer wall 411 may form the external appearance of the upper housing 41.

The first inner wall 412 may be disposed inside the first outer wall 411. The first inner wall 412 may be elongated. The first inner wall 412 may be elongated vertically. The first inner wall 412 may define therein the insertion space 46, which communicates with the outside. The first inner wall 412 may have a flat inner surface. The stick 10 may be inserted into the insertion space 46 defined by the first inner wall 412. The first inner wall 412 may include therein the insertion space 46, which is elongated. The insertion space 46 may be elongated in the longitudinal direction of the probe 71.

Meanwhile, the first inner wall 412 may be inclined in the longitudinal direction of the upper housing 41. The first inner wall 412 may be inclined inwards from the upper side thereof toward the lower side thereof. The inner diameter D1 of the lower portion of the first inner wall 412 may be smaller than the inner diameter D2 of the upper portion of the first inner wall 412. Since the first inner wall 412 is inclined, the lower portion of the stick 10 inserted into the insertion space 46 may be supported by the first inner wall 412. The cross-sectional area of each of the first inner wall 412 and the insertion space 46 may gradually decrease from the support rib 415 to a stopper 419.

In addition, since the gap between the circumference of the lower portion of the inserted stick 10 and the first inner wall 412 is hermetically sealed, it is possible to prevent the aerosol formed in the lower portion of the stick 10 from leaking through the gap between the stick 10 and the first inner wall 412.

The container 413 may be formed by the first outer wall 411, the first inner wall 412, a second outer wall 431 of the lower housing 43, and a second inner wall 432 of the lower housing 43. The container 413 may be disposed between the upper housing 41 and the lower housing 43. The container 413 may contain liquid used for formation of the aerosol. The container 413 may be hermetically sealed from the inside of the cartridge 40 by the first gasket 42. The container 413 may be hermetically sealed from the outside of the cartridge 40 by the second gasket 44. The liquid stored in the container 413 may permeate the wick 47. The container 413 may be named as a container space.

The coupling groove414 may be formed in the first outer wall 411. The coupling groove414 may be formed in the shape of a hole. The coupling groove414 may be coupled with a coupling protrusion 454 of the base 45. A plurality of coupling recesses 414 may be formed in the circumference of the upper housing 41. The plurality of coupling recesses 414 may be arranged at regular intervals.

The support rib 415 may be formed on the first inner wall 412. The support rib 415 may be located adjacent to the upper end of the insertion space 46. The support rib 415 may protrude from the first inner wall 412 toward the insertion space 46. When the stick 10 is inserted into the insertion space 46, the support rib 415 may come into contact with the stick 10 inserted into the insertion space 46. The support rib 415 may support the lateral surface of the inserted stick 10. The fixing force for fixing the inserted stick 10 may vary depending on how far the support rib 415 protrudes or the shape thereof.

The support rib 415 may be formed in a plural number, and the plurality of support ribs 415 may be sequentially disposed along the inner circumference of the first inner wall 412. The plurality of support ribs 415 may be connected to each other so as to be integrated.

Meanwhile, referring to FIG. 16, the plurality of support ribs 415 may be connected to each other to form a polygonal shape. For example, the support ribs 415 may form a regular hexagonal shape. Accordingly, it is possible to reliably support the circumference of the stick 10 inserted into the insertion space 46.

The cap-receiving portion 416 may be formed in the upper housing 41. The cap-receiving portion 416 may be located below the cap 22. When the cap 22 of the cover 20 is rotated, the cap 22 may be received in the cap-receiving portion 416. The cap-receiving portion 416 may be formed in a manner such that a portion of the upper housing 41 is recessed. The cap-receiving portion 416 may be formed in a manner such that the first inner wall 412 is recessed. The cap-receiving portion 416 may be formed in the upper portion of the upper housing 41. The cap-receiving portion 416 may communicate with the opening 417. The cap-receiving portion 416 may have a shape corresponding to the shape of the cap 22. The cap-receiving portion 416 may be engaged with the cap 22 that has been rotated.

The opening 417 may communicate with the insertion space 46. The opening 417 may communicate with the outside of the cartridge 40. The opening 417 may communicate with the cap-receiving portion 416. The opening 417 may be formed in the upper surface of the upper housing 41. The stick 10 may be inserted into the insertion space 46 through the opening 417. The stick 10 may be inserted through the opening 417 from above to below.

The slope 41*a* may be formed on the first inner wall 412. The slope 41*a* may be formed between the opening 417 and the support rib 415. The slope 41*a* may be formed between the cap-receiving portion 416 and the support rib 415. The slope 41*a* may interconnect the support rib 415 and the opening 417. The slope 41*a* may be inclined inwards from above to below. The cap-receiving portion 416 may be connected to the upper side of the slope 41*a*, and the support rib 415 may be connected to the lower side of the slope 41*a*. The slope 41*a* may enable the stick 10 to be smoothly inserted into the insertion space 46 along the slope 41*a*.

The lower housing 43 may include a second outer wall 431, a second inner wall 432, and a second inlet 433. The lower housing 43 may be coupled to the lower side of the upper housing 41. The lower housing 43 may be elongated in the longitudinal direction of the upper housing 41. Alternatively, the lower housing 43 may be elongated in the vertical direction.

The second outer wall 431 may be coupled to the first outer wall 411. The second outer wall 431 may be coupled to the lower side of the first outer wall 411. The second outer wall 431 may be integrally formed with the second inner wall 432. The second outer wall 431 may be disposed inside the cartridge 40. The second outer wall 431 may form the external appearance of the lower housing 43. The second outer wall 431 and the second inner wall 432 may be connected to each other.

The second inner wall 432 may be coupled to the first inner wall 412. The second inner wall 432 may be coupled to the lower side of the first inner wall 412. The second inner wall 432 may be disposed below the insertion space 46. The inside of the second inner wall 432 may communicate with the insertion space 46. The wick 47 and the heater 48 may be disposed inside the second inner wall 432.

The liquid vaporization space 49 may be located inside the second inner wall 432. The aerosol formed in the liquid vaporization space 49 may flow to the stick 10 inserted into the insertion space 46. The user may inhale the aerosol formed in the liquid vaporization space through the stick 10.

The second inlet 433 may be formed in the lower housing 43. The liquid vaporization space 49 may communicate with the outside of the lower housing 43 through the second inlet. Air may flow to the wick 47 and the heater 48 through the second inlet 433. The second inlet 433 may be located near the wick 47. The second inlet 433 may be located below the wick 47. The second inlet 433 may be formed in the bottom surface 430 of the lower housing 43.

The lower housing 43 may be mounted in the base 45. The lower housing 43 may be accommodated in the base 45. The outer side of the base 45 may be inserted into the gap between the first outer wall 411 and the second outer wall 431. The base 45 may be coupled to the upper housing 41. The base 45 may be elongated. The base 45 may be elongated in the longitudinal direction of the upper housing 43. The base 45 may surround the lower housing 43. The base 45 may be spaced apart from the bottom surface 430 of the lower housing 43.

The base 45 may include a first inlet 451. The first inlet 451 may be formed in the lateral surface 458 of the base 45. The inside of the base 45 and the outside of the base 45 may communicate with each other through the first inlet 451. The first inlet 451 may communicate with the second inlet 433. The first inlet 451 may be spaced apart from the bottom surface 457 of the base 45. The first inlet 451 may be spaced upwards apart from the bottom surface 457 of the base 45, thereby preventing leakage of droplets remaining in the lower portion of the base 45.

The base 45 may include a coupling protrusion 454. The coupling protrusion 454 may protrude from the lateral surface 458 of the base 45. The coupling protrusion 454 may be formed on the upper portion of the base 45, and may be fitted into the coupling groove414 formed in the lower portion of the first outer wall 411.

The wick 47 may be located in the liquid vaporization space 49 inside the lower housing 43. A portion of the wick 47 may be connected to the inside of the container 413. The wick 47 may be connected to the inside of the container 413 to absorb the liquid contained in the container 413. The wick 47 may be elongated. The wick 47 may communicate with the insertion space 46. The wick 47 may be located below the insertion space 46.

Meanwhile, the wick 47 may extend toward the lower side of the container 413. Therefore, when a small amount of liquid is left in the container 413, the liquid may permeate the wick 47 even if the user does not shake or invert the aerosol-generating device 1.

The heater 48 may be located in the liquid vaporization space 49. The heater 48 may be disposed near the wick 47. The heater 48 may receive power from a battery 58 (refer to FIG. 14) to generate heat. The heater 48 may apply heat to the wick 47. The heater 48 may be formed so as to be wound around the wick 47. The heater 48 may be located inside the second inner wall 432.

When the heater 48 applies heat to the wick 47, the liquid that has permeated the wick 47 may be vaporized to form an aerosol. The formed aerosol may rise into the insertion space 46. The user may inhale the formed aerosol through the stick 10 inserted into the insertion space 46.

Referring to FIGS. 9 and 10, the aerosol-generating device 1 may include a first gasket 42 and a second gasket 44.

The first outer wall 411 of the upper housing 41 may include a stepped portion 418. The first inner wall 412 of the upper housing 41 may include a compression protrusion 410 and a stopper 419. The second outer wall 431 of the lower housing 43 may include a flange 434.

The first gasket 42 may be inserted into the gap between the first inner wall 412 and the second inner wall 432 so as to be compressed therebetween. The first gasket 42 may be inserted into the gap between the lower end of the first inner wall 412 and the upper end of the second inner wall 432. The first gasket 42 may be disposed along the circumference of the upper portion of the second inner wall 432. The first gasket 42 may be formed of an elastic material. The first gasket 42 may prevent the liquid contained in the container 413 from leaking into the liquid vaporization space 49.

The first gasket 42 may extend along the second inner wall 432 in the longitudinal direction of the second inner wall 432. In addition, the elongated first gasket 42 and the first inner wall 412 may be in contact with each other. An extension portion 421 of the first gasket 42 (refer to FIG. 13) may be inserted into the gap between the second inner wall 432 and the first inner wall 412 so as to be compressed therebetween. Accordingly, it is possible to prevent the liquid in the container 413 from leaking into the liquid vaporization space 49.

The second gasket 44 may be inserted into the gap between the first outer wall 411 and the second outer wall 431 so as to be compressed therebetween. The second gasket 44 may extend along the circumference of the base 45. The second gasket 44 may be inserted into the gap between the second outer wall 431 and the base 45. The second gasket 44 may be inserted into the gap between the first outer wall 411 and the base 45. The second gasket 44 may prevent the liquid contained in the container 413 from leaking out of the cartridge 40.

The second gasket 44 may include a compressed portion 441, which is inserted into the gap between the flange 434 and the lateral surface 458 of the base 45, and an extension portion 442, which extends from the compressed portion 441 along the lateral surface 458 of the base 45 and is inserted into the gap between the base 45 and the first outer wall 411. Accordingly, it is possible to prevent the liquid in the container 413 from leaking into the gap between the lower housing 43 and the base 45 or leaking into the gap between the base 45 and the upper housing 41.

The stepped portion 418 may be formed on the inner surface of the first outer wall 411. The stepped portion 418 may be engaged with the flange 434. The stepped portion 418 may press the flange 434 of the second outer wall 431. The stepped portion 418 may press the second gasket 44. When the first outer wall 411 of the upper housing 41 is coupled to the base 45, the stepped portion 418 of the first outer wall 411 may press the flange 434 of the second outer wall 431 and the second gasket 44. Accordingly, when the upper housing 41 and the base 45 are coupled to each other, the second gasket 44 may be compressed, and may come into close contact with the first outer wall 411, the second outer wall 431, and the base 45.

The flange 434 may be formed in a manner such that an end portion of the second outer wall 431 is bent and extends outside the lower housing 43. The flange 434 may be formed in a manner such that the upper end of the second outer wall 431 is bent and extends outwards. The flange 434 may be coupled to the stepped portion 418. The flange 434 may be in contact with the stepped portion 418. When the first outer wall 411 is coupled to the base 45, the flange 434 may be pressed by the stepped portion 418. The lower side of the flange 434 may be in contact with the second gasket 44.

The compression protrusion 410 may protrude from the first inner wall 412 to the inside of the upper housing 41. The first gasket 42 may be inserted into the gap between the compression protrusion 410 and the second inner wall 432. The lower surface of the compression protrusion 410 may compress the first gasket 42. The compression protrusion 410 may compress a compressed portion 423 of the first gasket 42.

The compression protrusion 410 may extend so as to surround the inner circumference of the compressed portion 423 of the first gasket 42. The compression protrusion 410 extending along the first gasket 42 may be adjacent to the second inner wall 432. The compression protrusion 410 extending along the first gasket 42 may in contact with the second inner wall 432. Accordingly, it is possible to prevent the liquid in the container 413 from leaking into the liquid vaporization space 49.

The stopper 419 may be formed on the inner side of the first inner wall 412. The stopper 419 may be integrally formed with the compression protrusion 410. The stopper may be formed on the upper side of the compression protrusion 410. The stopper 419 may be formed below the support rib 415. The stopper 419 may be formed between the compression protrusion 410 and the support rib 415. The stopper 419 may be located adjacent to the compression protrusion 410.

The upper surface of the stopper 419 may support the stick 10 inserted into the insertion space 46. The stopper 419 may prevent the stick 10 from being inserted into the insertion space 46 beyond a predetermined depth. The stopper 419 may be formed in a plural number. The plurality of stoppers 419 may be integrally formed with each other. The plurality of stoppers 419 may be disposed at the same vertical position in the longitudinal direction of the upper housing 41. The plurality of stoppers 419 may be arranged along the inner circumference of the upper housing 41. The plurality of stoppers 419 may be in contact with the lower surface of the stick 10.

Referring to FIGS. 11 and 12, the aerosol-generating device 1 may include a probe 71, a first sealer 81, and a second sealer 82. The upper housing 41 may include a support 420. The lower housing 43 may include a depressed portion 435, a holder 436, and a hole 437.

The probe 71 may be elongated. The probe 71 may be elongated in the longitudinal direction of the upper housing 41. The probe 71 may be provided to be movable in the longitudinal direction of the upper housing 41. The probe 71 may penetrate the lower housing 43. The probe 71 may penetrate the base 45. The probe 71 may move from the insertion space 46 to the outside of the lower housing 43.

The probe 71 may include one end 714, which is adjacent to a force sensor 72 (refer to FIG. 14), a first part 715, which is elongated from the end 714 and moves through the hole 437 in the holder 436, an opposite end 713, which is formed opposite the end 714 and is located in the insertion space 46, a second part 716, which is elongated from the opposite end 713 and moves in the longitudinal direction of the insertion space 46, a third part 717, which interconnects the first part 715 and the second part 716 and intersects the longitudinal direction of the first part 715 or the second part 716, and a latching rib 712.

The opposite end 713 of the probe 71 may be located at the center of the cross-section of the insertion space 46, which is elongated in the longitudinal direction of the probe 71. The opposite end 713 of the probe 71 may be in contact with the center of the stick 10 inserted into the insertion space 46. The opposite end 713 of the probe 71 may be inserted into the center of the stick 10. Accordingly, the probe 71 may move in the longitudinal direction of the probe 71 a distance corresponding to the length to which the stick 10 is inserted, and may transmit the force with which the stick 10 pushes the probe 71 in the insertion process to the force sensor 72.

The end 714 of the probe 71 may be adjacent to the second inner wall 432 of the lower housing 43. The end 714 and the opposite end 713 of the probe 71 may be positioned on different axes when viewed in the longitudinal direction of the probe 71. When viewed in the longitudinal direction of the probe 71, the end 714 of the probe 71 may be located outside the insertion space 46, and the opposite end 713 of the probe 71 may be located inside the insertion space 46 (at the center thereof).

The first part 715 may be elongated from the end 714 of the probe 71. The first part 715 may move through the hole 437 in the holder 436. The first part 715 may be elongated in the longitudinal direction of the insertion space 46.

The second part 716 may be elongated from the opposite end 713 of the probe 71. The second part 716 may extend in the longitudinal direction of the insertion space 46. The second part 716 may move in the insertion space 46 in the longitudinal direction of the insertion space 46.

The third part 717 may be bent so as to interconnect the end 714 of the probe 71, which is located at the center of the insertion space 46, and the opposite end 713 of the probe 71, which is adjacent to the second inner wall 432. The third part 717 may be elongated in a direction intersecting the longitudinal direction of the probe 71. For example, the third part 717 may be elongated in a direction perpendicular to the longitudinal direction of the probe 71.

Meanwhile, the third part 717 may be located above the wick 47. Accordingly, it is possible to prevent the liquid or droplets falling from the wick 47 from leaking out of the cartridge 40 along the third part 717.

The latching rib 712 may protrude from the lateral surface of the probe 71 in a direction intersecting the moving direction of the probe 71. The latching rib 712 may be caught by the support 420 of the first inner wall 412. The latching rib 712 may be elongated in the longitudinal direction of the probe 71. The latching rib 712 may be located below the support 420. The latching rib 712 may be located between the upper housing 41 and the force sensor 72. The latching rib 712 may prevent the probe 71 from moving a predetermined distance or more toward the insertion space 46.

The first sealer 81 may include a thin film 811. The first sealer 81 may be in contact with the first inlet 451 in the base 45. The first sealer 81 may extend along the circumference of the first inlet 451. The first sealer 81 may be inserted into the lower housing 43. The first sealer 81 may be inserted into the gap between the second outer wall 431 of the lower housing 43 and the base 45. The first sealer 81 may be inserted into the gap between the second outer wall 431 of the lower housing 43 and the first inlet 451. The first sealer 81 may be formed of an elastic material.

The first sealer 81 may prevent the liquid in the container 413 from leaking into the first inlet 451 through the gap between the lower housing 43 and the base 45. In addition, since the first sealer 81 hermetically seals the circumference of the first inlet 451, it is possible to maintain the air pressure in the first inlet 451 during inhalation by the user.

The thin film 811 may be disposed in the first inlet 451. The thin film 811 may be disposed in the flow path of the air suctioned through the first inlet 451. The thin film 811 may have formed therein a plurality of pores. Accordingly, since the liquid does not pass through the plurality of pores, it is possible to prevent the liquid from leaking out of the cartridge 40.

The probe 71 may be inserted into the second sealer 82. The second sealer 82 may be supported by the base 45. The second sealer 82 may be supported by the lower housing 43. The second sealer 82 may prevent the liquid from leaking out of the cartridge 40 along the probe 71.

The support 420 may protrude inwards from the first inner wall 412 of the upper housing 41. The support 420 may protrude toward the probe 71. The support 420 may be located adjacent to the lateral surface of the probe 71. The support 420 may support the lateral surface of the probe 71 when the probe 71 is tilted.

The depressed portion 435 may be formed in a manner such that the bottom surface 430 of the lower housing 43 is recessed into the lower housing 43. When the aerosol-generating device 1 is inverted, droplets remaining between the lower housing 43 and the base 45 may accumulate in the depressed portion 435. The depressed portion 435 may prevent droplets from leaking into the first inlet 451.

The holder 436 may be formed at the lower housing 43. The holder 436 may be formed at the second inner wall 432 of the lower housing 43. The holder 436 may be integrally formed with the lower housing 43. The holder 436 may have formed therein a hole 437 through which the probe 71 slides. The holder 436 may allow the probe 71 to pass therethrough. The holder 436 may be elongated in the longitudinal direction of the probe 71. The hole 437 in the holder 436 may be elongated in the longitudinal direction of the probe 71. The hole 437 in the holder 436 may have a shape corresponding to the cross-section of the probe 71. The hole 437 may support the lateral surface of the probe 71.

Meanwhile, the support 420 may be located above the latching rib 712 of the probe 71. The support 420, the latching rib 712, and the holder 436 may be sequentially arranged in the longitudinal direction of the upper housing 41. The support 420 may be located above the latching rib 712. The holder 436 may be located below the latching rib 712. Accordingly, when the probe 71 moves in the longitudinal direction thereof, the support 420 and the holder 436 may restrict excessive movement of the probe 71.

Referring to FIG. 13, the second inner wall 432 of the lower housing 43 may include a notch 439. The first gasket 42 may include an extension portion 421, an insertion portion 422, and a compressed portion 423.

The notch 439 may be formed in one end of the second inner wall 432. The notch 439 may be recessed in the longitudinal direction of the upper housing 41. That is, the notch 439 formed in the upper end of the second inner wall 432 may be recessed downwards. The wick 47 may be inserted into and seated in the notch 439. The wick 47 may be disposed inside the notch 439. The notch 439 may have a shape corresponding to the external appearance of the wick 47. Accordingly, the wick 47 may be disposed between the notch 439 and the insertion portion 422 so as to be in close contact with the same, thereby preventing leakage of the liquid.

The first gasket 42 may include the extension portion 421, which extends from the compressed portion 423 along the outer surface of the second inner wall 432 and is inserted into the gap between the first inner wall 412 and the second inner wall 432, the compressed portion 423, which is inserted into the gap between the first inner wall 412 and the second inner wall 432, and the insertion portion 422, which extends from the compressed portion 423 and is inserted into the notch 439.

The extension portion 421 may extend from the compressed portion 423. The extension portion 421 may extend along the second inner wall 432 in the longitudinal direction of the second inner wall 432. The first inner wall 412 of the upper housing 41 may extend along the extension portion 421. The extension portion 421 may be inserted into the gap between the second inner wall 432 and the extended first inner wall 412.

The insertion portion 422 may extend downwards from the compressed portion 423 of the first gasket 42. The insertion portion 422 may be in contact with the wick 47 seated in the notch 439. The insertion portion 422 may have a shape corresponding to the external appearance of the wick 47. Accordingly, the insertion portion 422 may be in close contact with the wick 47, thereby preventing leakage of the liquid along the outer surface of the wick 47.

Referring to FIG. 14, the aerosol-generating device 1 may include a first flow path 91, a second flow path 92, and a third flow path 93. In addition, the aerosol-generating device 1 may include a first gap 225, a second gap 520, a first opening 521, an suction detection sensor 53, a second opening 522, a first inlet 451, a second inlet 433, a battery 58, and a terminal 59.

The first flow path 91 may be formed through the first gap 225, which is located between the insertion hole 21 in the cover 20 and the stick 10, and the second gap 520, which is formed between the upper casing 30 and the column 52. The first flow path 91 may be named as a casing flow path. Air for generation of the aerosol may be suctioned through the first gap 225. The air suctioned into the insertion hole 21 may be introduced into the second gap 520 between the upper casing 30 and the column 52. The air introduced into the second gap 520 may pass through the first opening 521 formed in the column 52. That is, the first flow path 91 may sequentially interconnect the insertion hole 21, the second gap 520, and the first opening 521.

The second flow path 92 may interconnect the first opening 521 and the second opening 522, which are formed in the column 52. The second flow path 92 may be located inside the column 52. The second flow path 92 may be named as a column flow path. The second flow path 92 may be connected to the first flow path 91.

The third flow path 93 may be formed through the first inlet 451 in the base 45, the second inlet 433 in the lower housing 43, and a region near the wick 47. The second inlet 433 may be formed in the third flow path 93. The third flow path 93 may be connected to the second flow path 92. The third flow path 93 may lead to the inserted stick 10 from the first inlet 451. Since the third flow path 93 passes by the wick 47, the liquid vaporized by the heater 48 may mix with air. Accordingly, the user may inhale the aerosol through the stick 10.

The third flow path 93 may be located between the bottom surface 430 of the lower housing 43 and the base 45. The third flow path 93 may be named as a base flow path. The third flow path 93 may form a wide flow path between the lower housing 43 and the base 45, and may secure a sufficient flow rate.

The battery 58 (refer to FIG. 22) may be mounted in the body 50. The battery 58 may be located at the lower portion of the body 50. The battery 58 may supply power to the heater 48. The battery 58 may supply power to the controller 100. The battery 58 may supply power to an electronic device included in the aerosol-generating device 1. The battery 58 may supply power to an output unit 110, the force sensor 72, and a memory 120.

The terminal 59 may be connected to the battery 58. The terminal 59 may be connected to an external power source. The battery 58 may receive power from the outside through the terminal 59.

The first flow path 91 and the second flow path 92 will be described with reference to FIGS. 15 to 18.

The first gap 225 may be formed between the insertion hole 21 and the stick 10 inserted into the insertion hole 21. Air may pass through the first gap 225. The air that has passed through the first gap 225 may be introduced into the column 52 through the second gap 520.

The second gap 520 may be formed between the upper casing 30 and the column 52. The second gap 520 may be formed near the column 52. The surface 32 of the upper casing 30, the upper surface of the upper housing 41, and the surface 523 of the column 52, which together form the second gap 520, may be formed to be flat. The second gap 520 may communicate with the first opening 521. The second gap 520 may be formed by a spacing protrusion 31 of the upper casing 30.

The spacing protrusion 31 may form the second gap 520. The spacing protrusion 31 may be adjacent to the first opening 521. The spacing protrusion 31 may protrude from the portion of the upper casing 30 that faces the first opening 521. The spacing protrusion 31 may be in contact with the upper housing 41 or the column 52. The spacing protrusion 31 may separate the upper casing 30 and the column 52 from each other. The spacing protrusion 31 may define the width of the second gap 520.

The first opening 521 may allow the first flow path 91 and the second flow path 92 to be connected to each other. The first opening 521 may allow the second gap 520 and the inside of the column 52 to communicate with each other. The first opening 521 may be formed in the outer surface of the column 52. The first opening 521 may be formed in the upper surface of the column 52. The first opening 521 may be adjacent to the upper housing 41 and the upper casing 30.

The suction detection sensor 53 may sense whether the user is inhaling. The suction detection sensor 53 may be mounted in the first flow path 91, the second flow path 92, or the third flow path 93.

The suction detection sensor 53 may be mounted in the second flow path 92. The suction detection sensor 53 may be spaced upwards apart from the second opening 522. The suction detection sensor 53 may be mounted between the first opening 521 and the second opening 522. The suction detection sensor 53 may be located on the inner surface of the column 52 that is adjacent to the cartridge 40. Accordingly, it is possible to prevent malfunction of the suction detection sensor 53, which may be caused by permeation of the liquid thereinto when the aerosol-generating device 1 is tilted or rotated.

The suction detection sensor 53 may sense the flow of air. The suction detection sensor 53 may be a pressure sensor or an airflow sensor. The suction detection sensor 53 may be disposed adjacent to the first opening 521 or the second opening 522. The suction detection sensor 53 may sense the flow of air passing through the second flow path 92.

The second opening 522 may allow the second flow path 92 and the third flow path 93 to be connected to each other. The second opening 522 may be formed in the surface of the column 52 that faces the lower housing 43 or the base 45.

The second opening 522 may be located adjacent to the lower housing 43 or the base 45. The second opening 522 may face the first inlet 451 in the base 45. The second opening 522 may be connected to the first inlet 451 in the base 45. A sealing member (not shown) may be inserted into the gap between the second opening 522 and the first inlet 451. The second opening 522 may be in close contact with the first inlet 451.

Meanwhile, the second inlet 433 may be offset from the wick 47 in the longitudinal direction of the upper housing 41 (or the vertical direction) so as to be positioned on different axes. That is, the second inlet 433 may be spaced apart from the wick 47 in the radial direction of the second inlet 433 or horizontal direction. Accordingly, since the liquid falling from the wick 47 does not directly flow into the second inlet 433, it is possible to prevent the liquid from leaking out of the cartridge 40.

Meanwhile, the hole 437 in the holder 436 may be offset from the wick 47 in the longitudinal direction of the upper housing 41 (or the vertical direction) so as to be positioned on different axes. That is, the hole 437 may be spaced apart from the wick 47 in the radial direction of the hole 437. The wick 47 may be located between the hole 437 and the second inlet 433 in the radial direction of the hole 437. In addition, the hole 437 in the holder 436 and the second inlet 433 may be located symmetrically to each other with respect to the wick 47. Accordingly, since the liquid falling from the wick 47 does not directly flow into the hole 437 in the holder 436, it is possible to prevent leakage of the liquid.

Referring to FIGS. 19 and 20, the aerosol-generating device 1 may include a first boss 452, a second boss 438, a wall 453, a first opening 455, a second opening 511, a force sensor 72, a second sealer 82, a controller 100, an output unit 110, and a memory 120.

The first opening 455 may be formed in the base 45. The first opening 455 may be formed in the bottom surface 457 of the base 45. The first opening 455 may allow the end 714 of the probe 71 to pass therethrough. The first opening 455 may be located below the holder 436. The first opening 455 and the second opening 511 may be arranged in the longitudinal direction of the probe 71.

The second opening 511 may be formed in the mount 51 of the body 50. The second opening 511 may allow the end 714 of the probe 71 to pass therethrough. The second opening 511 may be located below the first opening 455. A portion of the force sensor 72 may be located in the second opening 511.

The force sensor 72 may be mounted in the body 50. The force sensor 72 may be located adjacent to the end 714 of the probe 71. The force sensor 72 may be located below the probe 71. The force sensor 72 may include a sensing portion 721, which comes into contact with the end 714 of the probe 71 when the probe 71 moves from the insertion space 46 to the inside of the lower housing 43. The sensing portion 721 of the force sensor 72 may be pressed by the end 714 of the probe 71.

The force sensor 72 may measure a pressure value generated when the force sensor 72 comes into contact with the probe 71. The force sensor 72 may transmit the measured pressure value to the controller 100. The force sensor 72 may be named as a pressure sensor. A preset pressure value may be stored in the controller 100, and the controller 100 may make a comparison in magnitude between the pressure value measured by the force sensor 72 and the preset pressure value.

The surface of the sensing portion 721 that is in contact with the end 714 of the probe 71 may be formed as a curved surface. For example, the sensing portion 721 may include a curved surface that is convex toward the probe 71. Therefore, even if the probe 71 is tilted during movement thereof, the contact point between the end 714 and the sensing portion 721 may be formed at the center of the sensing portion 721. In addition, since a single contact point is formed, the accuracy of the force sensor 72 may be improved.

The second sealer 82 may include a first support portion 821, which is supported by the base 45, a second support portion 823, which is supported by the lower housing 43, a connection portion 822, which interconnects the first support portion 821 and a second support portion 823, and a contact portion 824, which is in contact with the probe 71.

The first support portion 821 may be supported by the first boss 452 protruding from the base 45. The lower surface of the first support portion 821 may be supported by the base 45, and the lateral surface of the first support portion 821 may be supported by the first boss 452. The first support portion 821 may be adhered to the base 45.

The second support portion 823 may be in contact with the lower housing 43. The second support portion 823 may extend along the bottom surface 430 of the lower housing 43. The second support portion 823 may surround the hole 437 in the holder 436. The second support portion 823 and the contact portion 824 may hermetically seal the hole 437 in the holder 436, thereby preventing the liquid from leaking out of the lower housing 43 through the hole 437 in the holder 436.

The first support portion 821 and the second support portion 823 may respectively support the lower surface and the upper surface of the second sealer 82. Accordingly, even if the probe 71 moves in the longitudinal direction thereof, the original position of the second sealer 82 in the longitudinal direction of the probe 71 may be maintained.

The contact portion 824 may surround the outer surface of the probe 71. The contact portion 824 may be located on the circumference of the probe 71. The contact portion 824 may be adhered to the probe 71. The contact portion 824 may extend in the longitudinal direction of the probe 71. The contact portion 824 may prevent the liquid that has leaked out of the lower housing 43 from leaking out of the base 45 along the probe 71.

Meanwhile, the aerosol-generating device 1 may include a plurality of protrusions (not shown) protruding from the base 45 to support the lateral surface of the second sealer 82. The plurality of protrusions may be symmetrically arranged with respect to the probe 71. The plurality of protrusions may be integrally formed with each other to have a boss shape.

The first boss 452 may protrude from the base 45. The first boss 452 may protrude from the base 45 toward the lower housing 43. The first boss 452 may support the lateral surface of the second sealer 82. The first boss 452 may support the outer surface of the first support portion 821. The first boss 452 may maintain the original position of the second sealer 82 in a direction perpendicular to the longitudinal direction of the probe 71.

The second boss 438 may protrude from the lower housing 43. The second boss 438 may protrude toward the base 45. The second boss 438 may surround the first boss 452. The second boss 438 may surround the outer side of the first boss 452. The second boss 438 and the first boss 452 may overlap each other in a direction intersecting the longitudinal direction of the probe 71. For example, the second boss 438 and the first boss 452 may overlap each other in a direction perpendicular to the longitudinal direction of the probe 71.

Accordingly, it is possible to prevent the liquid or droplets from permeating the first boss 452 from the outside of the second boss 438.

The wall 453 may be formed on the base 45. The wall 453 may protrude from the base 45 toward the second flow path 92. The wall 453 may protrude toward the lower housing 43. The wall 453 may be disposed between the second inlet 433 and the first inlet 451. The wall 453 may prevent the droplets from flowing back to the first inlet 451 along the second flow path 92.

Meanwhile, the wall 453 may be bent along the second flow path 92 or in a direction opposite the second flow path 92. The wall 453 may be bent toward the second inlet 433 or the first inlet 451. Accordingly, when the aerosol-generating device 1 is laid down or tilted, it is possible to effectively prevent leakage of the liquid into the first inlet 451.

FIG. 21 illustrates the case in which the probe 71 moves from the insertion space 46 to the outside of the lower housing 43 and the end 714 thereof comes into contact with the sensing portion 721 of the force sensor 72.

When the stick 10 is inserted into the insertion space 46, the probe 71, which is in contact with the stick 10, may move in the longitudinal direction of the probe 71. The second sealer 82 surrounding the probe 71 may move in the moving direction of the probe 71 as the probe 71 moves. Even if the liquid or droplets leak out of the lower housing 43 along the probe 71, the second sealer 82 may prevent the liquid or droplets from leaking out of the base 45.

When the end of the probe 71 comes into contact with the sensing portion 721, the pressure value sensed by the force sensor 72 may be transmitted to the controller 100. The controller 100 may compare the sensed pressure value with the preset pressure value, and may determine whether the stick 10 is a used one.

Referring to FIG. 22, the aerosol-generating device 1 may include a controller 100, an output unit 110, and a memory 120.

When the pressure value measured by the sensing portion 721 is greater than a preset value, the controller 100 may determine that the stick 10 is a new one. When the measured pressure value is less than the preset value, the controller 100 may determine that the stick 10 is a used one. That is, the controller 100 may determine whether the stick 10 inserted into the aerosol-generating device 1 is a used one based on the pressure value sensed by the force sensor 72.

The output unit 110 may include a display 111, a sound output unit 112, and a haptic output unit 113. The output unit 110 may be operated by the controller 100. Upon determining that the stick 10 is a used one, the controller 100 may output information indicating reuse of the stick 10 on the display 111. Upon determining that the stick 10 is a used one, the controller 100 may notify the user of information indicating reuse of the stick 10 through the sound output unit 112. Upon determining that the stick 10 is a used one, the controller 100 may transmit vibration to the user through the haptic output unit 113.

The memory 120 may store the preset pressure value. The memory 120 may be connected to the controller 100. The controller 100 may compare the preset pressure value stored in the memory 120 with the pressure value measured by the force sensor 72, and may determine whether the stick 10 is a used one.

Reuse of the stick 10 is undesirable because smoking quality is degraded and the risk of ignition of the stick 10 increases. Therefore, the force sensor 72 may be used in order to improve the smoking quality of the aerosol-generating device 1 and to prevent ignition attributable to reuse of the stick 10.

FIG. 23 illustrates a series of processes in which the stick 10 is inserted into the aerosol-generating device 1 and is then removed therefrom. FIG. 24 illustrates a series of processes in which a used stick 10' is inserted into the aerosol-generating device 1 and is then removed therefrom.

Referring to FIGS. 23 and 24, the stick 10 may be inserted into the aerosol-generating device 1. The opposite end 713 of the probe 71 may be inserted into the stick 10 inserted into the insertion space 46. The inserted stick 10 may press the probe 71. When the stick 10 presses the probe 71, the probe 71 may move in the longitudinal direction thereof. The probe 71 that has moved may come into contact with the force sensor 72.

When the stick 10 is inserted into the aerosol-generating device 1, contact of the probe 71 with the force sensor 72 may be maintained. Therefore, a pressure value may be continuously measured by the force sensor 72. The controller 100 may determine that the stick 10 has been inserted based on the pressure value continuously measured by the force sensor 72.

When the probe 71 is inserted into the stick 10, a hole 10" may be formed in one surface of the stick 10. For example, a hole 10" may be formed in the lower surface of a used stick 10'. The hole 10" may be located at the center of the cross-section of the stick 10'. The hole 10" may have a shape corresponding to the outer surface of the opposite end 713 of the probe 71.

When the used stick 10' is inserted again into the aerosol-generating device 1, the used stick 10' may press the probe 71. In the process in which the stick 10 or 10' is inserted into the aerosol-generating device 1, the force with which the new stick 10 presses the probe 71 may be greater than the force with which the used stick 10' presses the probe 71. Since the hole 10" is already formed in the used stick 10', the probe 71 may be smoothly inserted into the used stick 10'.

Therefore, the controller 100 may make a comparison in magnitude between the pressure value measured in the process of inserting the stick 10 and the preset pressure value, and may determine whether the stick 10 inserted into the aerosol-generating device 1 is a used one.

Referring to FIGS. 1 to 24, an aerosol-generating device in accordance with one aspect of the present disclosure may include a housing 40 and 50 including an insertion space 46 in communication with an outside of the housing 40 and 50, a probe 71 elongated and installed at the housing 40 and 50 such that the probe is movable from the insertion space 46 to the inside of the housing 40 and 50, a pressure sensor 72 installed in the housing 40 and 50 and located adjacent to one end 714 of the probe 71, and a second sealer 82 configured to receive the probe 71, wherein the second sealer 82 is located between the pressure sensor 72 and the insertion space 46.

In addition, in accordance with another aspect of the present disclosure, the second sealer 82 may be supported by the housing 40 and 50.

In addition, in accordance with another aspect of the present disclosure, the aerosol-generating device may further include a base 45 located between the housing 40 and 50 and the pressure sensor 72, wherein the second sealer is supported by the base, wherein the probe 71 may pass through the base 45.

In addition, in accordance with another aspect of the present disclosure, the second sealer 82 may be supported by the housing 40 and 50.

In addition, in accordance with another aspect of the present disclosure, the second sealer 82 may include a contact portion 824 surrounding the outer side of the probe 71.

In addition, in accordance with another aspect of the present disclosure, the contact portion 824 may extend in a longitudinal direction with respect to the probe 71.

In addition, in accordance with another aspect of the present disclosure, the second sealer 82 may be adhered to the probe 71.

In addition, in accordance with another aspect of the present disclosure, the second sealer 82 may be adhered to the base 45.

In addition, in accordance with another aspect of the present disclosure, the base 45 may include a first portion 452 protruding from the base 45 to support the lateral surface of the second sealer 82.

In addition, in accordance with another aspect of the present disclosure, the housing 40 and 50 may include a second portion 438 protruding toward the base 45 to surround the lateral surface of the first portion 452.

In addition, in accordance with another aspect of the present disclosure, the aerosol-generating device may further include a container 413 located in the housing 40 for storing liquid, a wick 47 in contact with the insertion space 46, wherein the wick 47 has a portion connected to the container 413, and a heater 48 disposed near the wick 47 for heating the wick 47.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An aerosol-generating device comprising:

a body;

a cartridge coupled to the body and having an insertion space open upwardly and a liquid vaporization space below the insertion space;

a wick disposed inside the liquid vaporization space;

a heater wound around the wick and configured to heat the wick;

a probe penetrating the cartridge and disposed within the insertion space across the liquid vaporization space, wherein the cartridge has a hole through which the probe passes;

a force sensor installed in the body and located below the probe; and a sealer located below the hole and surrounding the probe.

2. The aerosol-generating device according to claim 1, wherein the cartridge comprises a lower housing having the liquid vaporization space and the hole, and wherein the sealer is supported by the lower housing.

3. The aerosol-generating device according to claim 1, wherein the cartridge further comprises:

a base accommodating a lower housing, wherein the probe penetrates the base and the lower housing, and wherein the sealer is disposed between the lower housing and the base.

4. The aerosol-generating device according to claim 3, wherein the sealer is supported by the lower housing and the base.

5. The aerosol-generating device according to claim 3, wherein the sealer is adhered to the base.

6. The aerosol-generating device according to claim 3, wherein the base comprises a first boss protruding from the base to support a lateral surface of the sealer.

7. The aerosol-generating device according to claim 6, wherein the cartridge comprises a second boss protruding toward the base and surrounding a lateral surface of the first boss.

8. The aerosol-generating device according to claim 1, wherein the sealer comprises a contact portion surrounding an outer side of the probe.

9. The aerosol-generating device according to claim 8, wherein the probe is elongated in a vertical direction, and wherein the contact portion extends in a longitudinal direction of the probe.

10. The aerosol-generating device according to claim 8, wherein the sealer is adhered to the probe.

11. The aerosol-generating device according to claim 1, wherein when a stick is inserted into the insertion space, the probe is configured to move downward to press the force sensor, and wherein the sealer is configured to deform in response to the downward movement of the probe.

* * * * *